US012000104B1

(12) United States Patent
Seeley

(10) Patent No.: US 12,000,104 B1
(45) Date of Patent: Jun. 4, 2024

(54) GREEN GRAVITY RETAINING WALL

(71) Applicant: Theo Robert Seeley, Hacienda Heights, CA (US)

(72) Inventor: Theo Robert Seeley, Hacienda Heights, CA (US)

( * ) Notice: Subject to any disclaimer, the term of this patent is extended or adjusted under 35 U.S.C. 154(b) by 0 days.

(21) Appl. No.: 18/181,542

(22) Filed: Mar. 9, 2023

Related U.S. Application Data

(60) Provisional application No. 63/318,477, filed on Mar. 10, 2022.

(51) Int. Cl.
*E02D 29/00* (2006.01)
*E02D 29/02* (2006.01)

(52) U.S. Cl.
CPC ..... *E02D 29/0225* (2013.01); *E02D 29/025* (2013.01)

(58) Field of Classification Search
CPC ... E02D 29/0225; E02D 29/025; E02D 29/02; E02D 17/18; E02D 5/76; E02D 29/0241; E02D 17/205; E02D 5/20; E02D 2300/002; E02D 5/808; E02D 5/18; E02D 5/02; E02D 2250/0007; E02D 5/34; E02D 29/00; E02D 29/0233; E02D 29/0258; E02D 29/0266; E02D 29/0275; E02D 29/0283; E02D 29/0291
See application file for complete search history.

(56) References Cited

U.S. PATENT DOCUMENTS 3,332,244 A * 7/1967 Chalmers ..... E04C 5/07 52/309.3
3,975,917 A * 8/1976 Asayama ..... E02D 5/54 405/232
4,648,223 A * 3/1987 Richard ..... E04B 1/19 403/171
4,653,959 A * 3/1987 Richard ..... E02B 17/0004 405/195.1
5,064,313 A * 11/1991 Risi ..... E02D 29/0241 405/262
5,131,791 A * 7/1992 Kitziller ..... E02D 29/0241 405/262
5,224,801 A * 7/1993 Quaney ..... E02D 29/025 52/169.2
5,370,480 A * 12/1994 Quaney ..... E02D 29/0241 405/262
5,456,051 A * 10/1995 Queen ..... E04C 5/20 52/679

(Continued)

*Primary Examiner* — Edwin J Toledo-Duran

(57) ABSTRACT

This patent provides designs for an ecologically friendly gravity retaining walls using a wide variety of building materials. This patent provides a method to build gravity walls using random fill. Where fill material is placed and then grouted in a specific way to form a solid mass. The primary problem with grouting loose fill to form a solid mass is that it needs confinement. This patent presents steps to create a confined space for grouting a structural section to provide horizontal support of an external mass. This is accomplished by dividing the wall into three sections. From front to back, these are the face, the structural section, and the back drainage sections. By grouting these separately and tying them together with modified concrete covered rebar a complete wall can be built in a very efficient manner. Initially planter blocks were included, now those claims are submitted under application Ser. No. 18/507,899.

8 Claims, 17 Drawing Sheets

(56) References Cited

U.S. PATENT DOCUMENTS

| | | | | | |
|---|---|---|---|---|---|
| 5,472,296 | A * | 12/1995 | von Allmen | E02D 5/80 | 405/259.5 |
| 5,702,208 | A * | 12/1997 | Hilfiker | E02D 17/205 | 405/20 |
| 5,702,816 | A * | 12/1997 | Kaiser | B29C 70/52 | 428/408 |
| 6,036,405 | A * | 3/2000 | Nove | E02D 29/025 | 405/262 |
| 6,050,749 | A * | 4/2000 | Khamis | E02D 29/0225 | 405/262 |
| 7,909,541 | B1 * | 3/2011 | Beck, III | E02D 3/12 | 405/239 |
| 10,501,905 | B2 * | 12/2019 | Han | E02D 3/12 | |
| 2002/0031664 | A1 * | 3/2002 | Kaiser | E04C 5/03 | 425/114 |
| 2009/0269146 | A1 * | 10/2009 | Miljovski | E02D 5/44 | 405/233 |
| 2012/0304586 | A1 * | 12/2012 | Johnson, III | E04C 5/18 | 52/677 |
| 2017/0204608 | A1 * | 7/2017 | Yang | E04C 5/18 | |
| 2017/0247884 | A1 * | 8/2017 | Houston | C22C 38/12 | |
| 2022/0112719 | A1 * | 4/2022 | Lim | E04C 5/165 | |
| 2022/0356663 | A1 * | 11/2022 | Seeley | E02D 5/28 | |

* cited by examiner

GREEN GRAVITY RETAINING WALL

CROSS-REFERENCE TO RELATED APPLICATION

This patent application claims the benefit of the Provisional Patent Application 63/318,477 dated Mar. 10, 2022 for Green Gravity Retaining Wall. This is a continuation of that application and there is no new data presented herein that were not included in the Mar. 10, 2022, application. Also, this application uses the same modified steel rebar system described by this same inventor and claimed in patent application Ser. No. 17/505,645 and its Continuation In Part, patent application Ser. No. 18/346,376 which at this writing is under review.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM

Not Applicable

STATEMENT REGARDING PRIOR DISCLOSERS BY THE INVENTOR OR A JOINT INVENTOR

Not Applicable

TECHNICAL FIELD

This disclosure relates generally but not by way of limitation to the construction gravity retaining walls for the purpose of supporting ground where a vertical or near vertical change in elevation is desired.

BACKGROUND OF THE INVENTION

Traditional methods of ground support using a mass gravity wall typically involve large back cuts and compaction of select soil along with plastic or steel strips that rely upon the friction generated by the granular nature of the soil to hold the mass together so that it will function as a unit. Another method of constructing a gravity wall is to build a form and fill the form with Portland cement concrete to create a large, massive concrete block unit.

Unfortunately, existing construction methods suffer certain drawbacks. The common drawbacks to using concrete gravity walls are:

1. Large volumes of concrete are expensive.
2. Wood forms to contain a large volume of concrete are expensive and require a significant number of work hours to construct and dismantle.
3. Pouring large volumes of concrete does require several pieces of equipment and if one breaks down the operation must stop, but the concrete has a short time that is pumpable.

4. Wood forms that have been nailed together are typically damaged during disassembly and therefore, have limited reuse.

Steel or plastic ties in compacted fill have the following drawbacks:

1. The steel or plastic ties only work with a narrow range of soil types.
2. Steel or plastic ties must be placed at specific vertical intervals.
3. Steel is subject to corrosion, therefore corrosion resistant metals such as stainless steel are required which is expensive.
4. If an excavation is required at a later time, such as the construction of a buried utility the cutting of the ties will be extremely damaging to the integrity of the wall.
5. The compaction of fill soil causes vibration and can be very noise.
6. The vibrations from the compaction of the fill can cause the back cut to fail, or damage existing structures near the site.
7. If the onsite soil is not compatible with the reinforcing system then it must be disposed of and import soil will need to be imported to the site.

My patent presentation provides a new method for gravity walls that uses a wide verity of fill materials from boulder size rocks down to silt size soil, in addition it works well with inert demolition material. The basic premise is that if common steel rebar is installed into a random fill, then the fill being tied together with rebar will function as a single unit. The primary problem with common rebar is that it is designed to only work with Portland cement concrete. I have previously described how to overcome this limitation in my patent application Ser. No. 17/505,645 where prior to using the rebar it is first cast in Portland cement concrete that has an undulating shape. The concrete has minimum dimensions required to protect the steel from corrosion. Then the undulating shape makes it possible for material of lower strength to pass loads to or accept load from the steel rebar. Thus, the steel rebar will compensate for the random nature of the fill. This patent application also provides a method for testing the minimum strength of the random fill to ensure that the design of the gravity wall will result in the required minimum factor of safety against failure.

DESCRIPTION OF RELATED ART

The review letter dated May 18, 2023 from the USPTO for the Green Gravity Retaining Wall, patent application Ser. No. 18/181,542 sited one previous patent titled "Concrete Masonry Unit For Reinforced Retaining Wall" U.S. Pat. No. 6,050,749 and its a Continuation In Part Ser. No. 08/994,327 filed on Dec. 19, 1997, herein referred to as Patent 749. My review of the referenced patent found that it is primarily for attaching concrete block facing wall to Mechanically Stabilized Earth (MSE). The MSE wall systems use various types of steel or plastic reinforcement placed within the fill and then the fill is compacted to a specified dry density. The Patent 749 specifies that the compacted fill be granular soil, because that is the only soil that can develop sufficient friction between the compacted fill and the reinforcement. This is a well-known method of stabilizing a mass of compacted fill soil. It should be noted that the MSE systems will not work with cohesive soil, or large debris fill that is grouted in place, because the friction between the fill and the reinforcement is not sufficient to ensure that the fill mass will be stable. Also, the only Claim of the patent is for attaching the MSE fill reinforcing material to concrete masonry unit wall facing blocks for the purpose of providing the MSE compacted fill mass with a non-erosive concrete face.

In addition the above the Patent 749 also presents a method to use steel rods indicated as item number 66 as shown on FIG. 13 to tie the same concrete masonry wall unit facing blocks to anchors located deep inside the embankment that is being supported. This is also a well-known method of building retaining walls by using a system of tie-backs, or soil nails that are anchored deep enough into the embankment that they will provide all lateral support required to ensure the stability of the retaining wall without jeopardizing the overall stability of the embankment, compacted fill, and the wall face. The attachment of rods to the blocks of the wall uses concrete at the wall face only. This is shown as item 54 on FIG. 13. The patent does not suggest that the concrete 54 should be used elsewhere along the rod. Also, the patent does include a sleeve item 64 for the purpose of ensuring that the rod 66 will not be in contact with the fill soil that is in the gap between the embankment and the back side of the block wall. This is important because it ensures that when the nut item 62 is tightened all of the tension on the rod 66 will be transmitted to the anchor that is deep within the embankment. Patent 749 does not discuss the idea of using the reinforcement rod 66 for developing active and/or passive resistance within the fill because that would defeat the purpose of having the anchor and could make the wall unstable. Anchored walls are not gravity walls and incorrect use of the anchor rod 66 could jeopardize the stability of the wall.

DIFFERENCE BETWEEN SUBJECT PATENT AND RELATED ART

The subject patent proposed herein is to construct gravity retaining walls comprised of large loosely placed inert debris such as cobbles and boulder size rock or large pieces of concrete from the demolition of structures which are then grouted into large uniform mass that will safely support an embankment. This is accomplished using gravel size rock to fill the majority of the void space that occurs when large debris is used for fill. Along with the large debris and gravel a grid of modified steel rebars and grout pipes are placed in a predetermined pattern for the purpose of tying the inert debris fill together to form a large unified mass that is placed against an embankment that requires vertical and horizontal support, The final step is to force grout into the remaining void space to ensure that the mass that was loosely placed becomes a steel reinforced mass which uses active and passive pressure to ensure that it will function as a unified gravity retaining wall. The referenced modified steel rebar consists of rebar that has been placed in a concrete mold with an undulating shape where the minimum thickness of concrete is sufficient to prevent corrosion, and the maximum thickness is at least 1.5 times the minimum thickness. The molded concrete is allowed to cure such that it will not be damaged in handling when placed in the fill. The claim of this patent is a method to construct a large single mass gravity retaining wall from loosely placed large debris and gravel by including modified steel rebar and grouting the various parts into one solid mass gravity retaining wall. The subject patent does discuss the possible use of concrete masonry blocks to provide a face for the gravity wall, but such a block wall is not the only possible wall face, and no claim is made herein for attaching the steel reinforcing to concrete masonry blocks.

The subject patent originally proposed a design for a plantable concrete block that would work with the modified rebar and grouted gravity wall system. Because the proposed block design is not a method this inventor has determined to submit that as a divisional patent application. The block design is significantly different from the concrete masonry blocks discussed in patent 794 where it specifies a parallelepiped that when placed in courses each course is placed directly upon the lower course, the resulting face is a vertical plane. The plantable blocks claimed in the divisional patent are designed for each course to be set back 10 to 25 degrees from the course below so that the planter depression will be exposed to the air.

BRIEF DESCRIPTION OF THE PATENT

This patent provides a method to design, build and field test a gravity retaining wall that overcomes some of the limitations of existing methods. The wall uses common existing building materials to build a safe solid wall quickly at a minimum cost. In addition, this design is environmentally friendly because it can reuse inert demolition material for the general fill and most common types of soil which in many cases will reduce the cost and amount of fuel used for shipping the import fill soil. After the back cut is prepared and the wall face is constructed then random fill is placed along with the modified rebar and grout injection tubes. Then the fill is grouted as described and becomes one solid unit that will safely resist the forces generated by the retained soil and rock.

SPECIFICATIONS

This is the design for an ecologically friendly gravity retaining wall that uses the same modified rebar described and claimed by this inventor in patent application Ser. No. 17/505,645 and its CIP which at this writing is being reviewed by a U. S. Patent examiner. Although gravity walls are in common use, they are not very simple to construct. This is due to the fact that most systems only work with compacted granular soil. In cases where the native soil does not meet the specifications for the required granular soil, then the native soil must be disposed of off-site and replaced with import soil that meets the specification. This can result in significant trucking costs. Or in the case where a wall will require significant volume of fill to meet the new proposed grade and granular soil is not found near the site, and again in that case the import cost can become a large part of the total cost. What is proposed here is to use on-site soil regardless of the soil type. Also, even cobble and bolder size stones along with demolition concrete debris could be used for the wall fill material. As the name "GRAVITY WALL" implies the most important aspect of the wall is its overall weight. The second key component of a gravity wall is to engineer the fill so that it functions as a single unit. This is commonly done using small steel, or plastic ties placed in the fill as it is compacted in thin layers. This is a slow process as the fill must be compacted in thin lifts and tested frequently.

The design proposed herein is to construct a vertical wall face at the desired location on a small concrete footing. Then backfill the space between the back of wall and the native slope with available material placed loosely and then in thick lifts grout the various materials into a solid mass of sufficient, strength, size and weight to prevent failure of the native or fill slope that is being retained. There are problems with this method that this patent proses to mitigate. Those problems are:

1. Grout can block drainage of the native or fill soil that lies beyond the back of the gravity wall. This is especially true if an expansive grout or grout under pressure is used as it will flow into the retained soil formation and form an impermeable layer. What is proposed herein is to divide the fill zone into three parts to solve this problem. First use drainage fabric down the face of the false/temporary back slope. These run the full height of the slope down to the bottom where the strips connect to a main collector drain. Second cover the drainage fabric with sufficient concrete to prevent intrusion of the grout into the drainage fabric system. Third is to treat the zone close to the false slope as a nonessential nonstructural zone. In other words, only lightly grout the wall fill material that is close to the drainage system. This zone only needs to be grouted sufficiently to prevent movement or settlement of the wall fill.
2. The second concern is that expansive grout can place a very large temporary load on the wall face. Therefore, what is proposed here is that either non-expansive grout be used, or only small amounts of grout be used adjacent to the back side of the wall face prior to grouting the structural fill zone. By using fill along the back of wall that has large open pore space the grout will not impose excessive pressure on the wall face. The primary need for this grouted zone is to attach the fill to the wall face. This results in a thicker stronger wall face. By creating a thick wall face the wall will be protected from the high pressure generated by the grouting of the structural fill zone. Having a thicker wall face will result in the grout pressure being dissipated over a larger zone along the wall face. The dissipation of force over a large area results in a smaller pressure at any given point along the wall face. This smaller pressure will not exceed the wall's ability to withstand the temporary pressure.
3. The entire mass of the gravity wall must act as a unit that has sufficient strength to prevent a mid-height failure plane from passing through the wall fill. Older gravity walls used unreinforced concrete. This will work however the strength of the concrete far exceeds what is necessary to provide a stable condition. This patent proposes a more economical method to produce the same satisfactory result. First to ensure that the wall will not fail from a near horizontal failure plane slicing through the wall at its mid-height, the wall fill must function as a unit and needs to have a minimum shear strength that far exceeds any possible loading condition. The shear strength needed for the wall can be calculated by running a series of slope stability analyses using a typical computer program. The program would use various strengths for the center section of the wall fill until all possible failure modes have the desired minimum factor of safety. Then the goal of the design is to ensure that the center structural fill will meet or exceed those minimum values. This should not be a problem given that soil strength is typically a minor fraction of the strength of grout. As described above the fill could consist of gravel, rocks and concrete debris held in place by the grout. These materials typically have strength expressed in thousands of pounds per square inch. Therefore, if the grout is the weakest material in the fill, then the entire mass will meet the minimum strength requirement.
4. To ensure that the three zones will function as one large mass it is proposed that they be held together by steel rebar. The problems with steel rebar are corrosion and small ribs on the bars are only designed to work with Portland cement concrete. The small ribs on steel rebar will not work well for the transfer of load from grouted soil to the steel. Therefore, it is recommended to modify the rebar with cured concrete nodes along the length of the rebar. This modification of the rebar solves both problems. The concrete will protect the steel from corrosion, and the nodes will provide a larger surface for efficient load transfer from the grouted fill to the steel and the reverse where the fill needs additional strength. The modified rebar can be used for several purposes. First is to attach the wall face to the main body of the fill mass. Second is to place modified rebar along the length of the wall face to ensure a uniform capacity along the entire length of the wall. These longitudinal modified rebars would help spread the capacity along the wall to mitigate the negative effects caused by anomalies. Given that wall backfill is randomly placed and grout flows in an uneven fashion, there will be anomalies. The solution to fill that is variable, is to tie the fill together in all directions with modified rebar so that the wall fill functions as a unit. Third is if the fill will be supporting a load such as a roadway, then the longitudinal modified rebar will spread the load in the same fashion as a grade beam and reduce the flexing of the road subgrade. A fourth use of the modified rebar is to provide a field-testing system, by placing vertical rebar in a section of the fill that is designed to have the lowest strength and load testing it when the fill is grouted. This will verify the lowest strength in the grouted fill. As long as this strength exceeds the minimum required strength then the gravity wall functioning as a unit will be stable.

A quick list of the Figures is:

FIG. 1. shows a perspective view of the wall at the beginning of the construction process prior to any fill being placed. This also shows the location of two cross sections for FIGS. 2A, 2B, 2C, 2D, and 2E in contrast to FIGS. 3A, 3B, 3C, 3D, and 3E.

Figure 4:
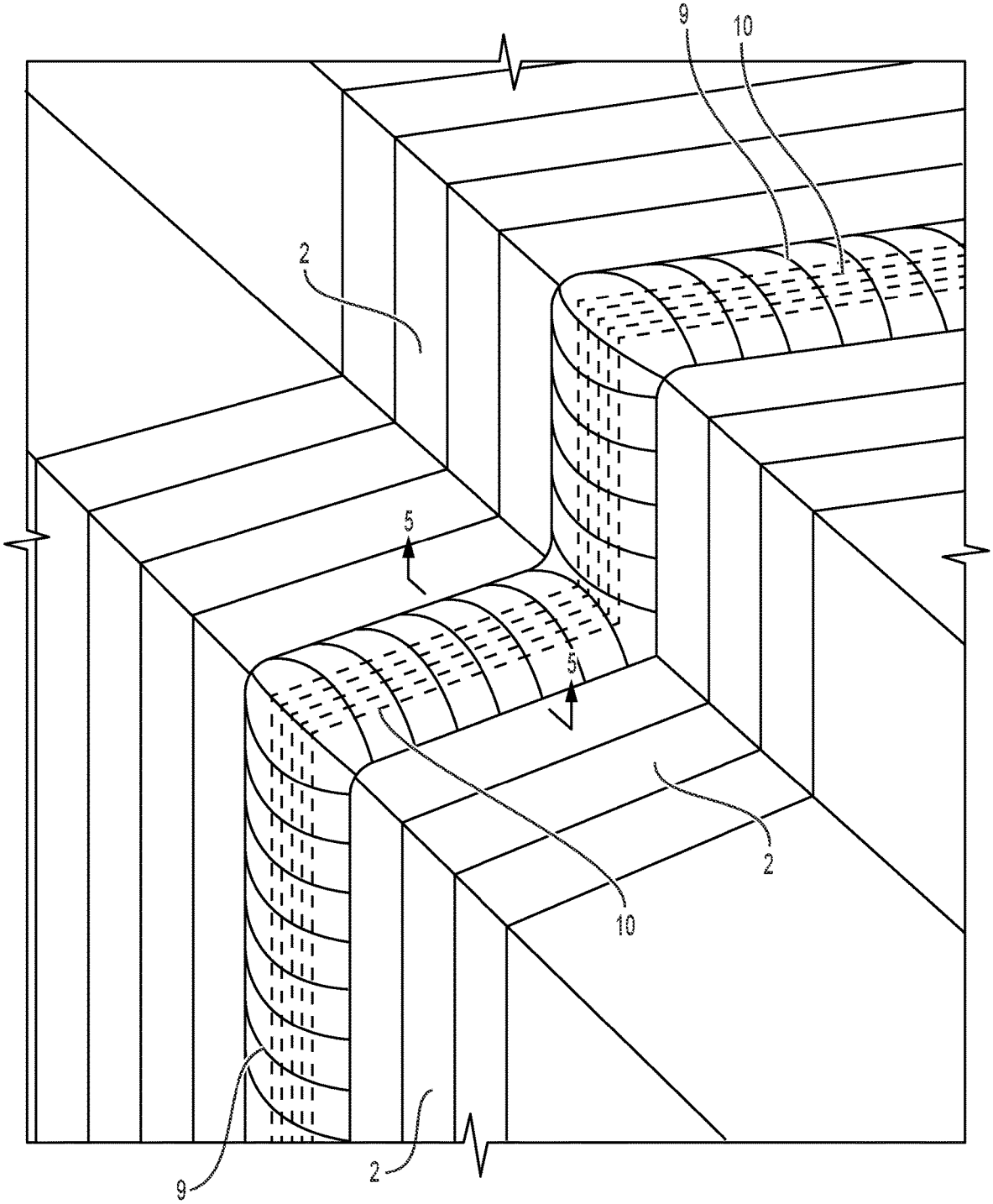

FIG. 4 Presents a typical perspective of the back cut and the concrete covered drainage material. The concrete cover is to prevent the grout from entering the drainage material. Also, shown is the FIG. 5 section of the concrete and drainage material.

Figure 5:
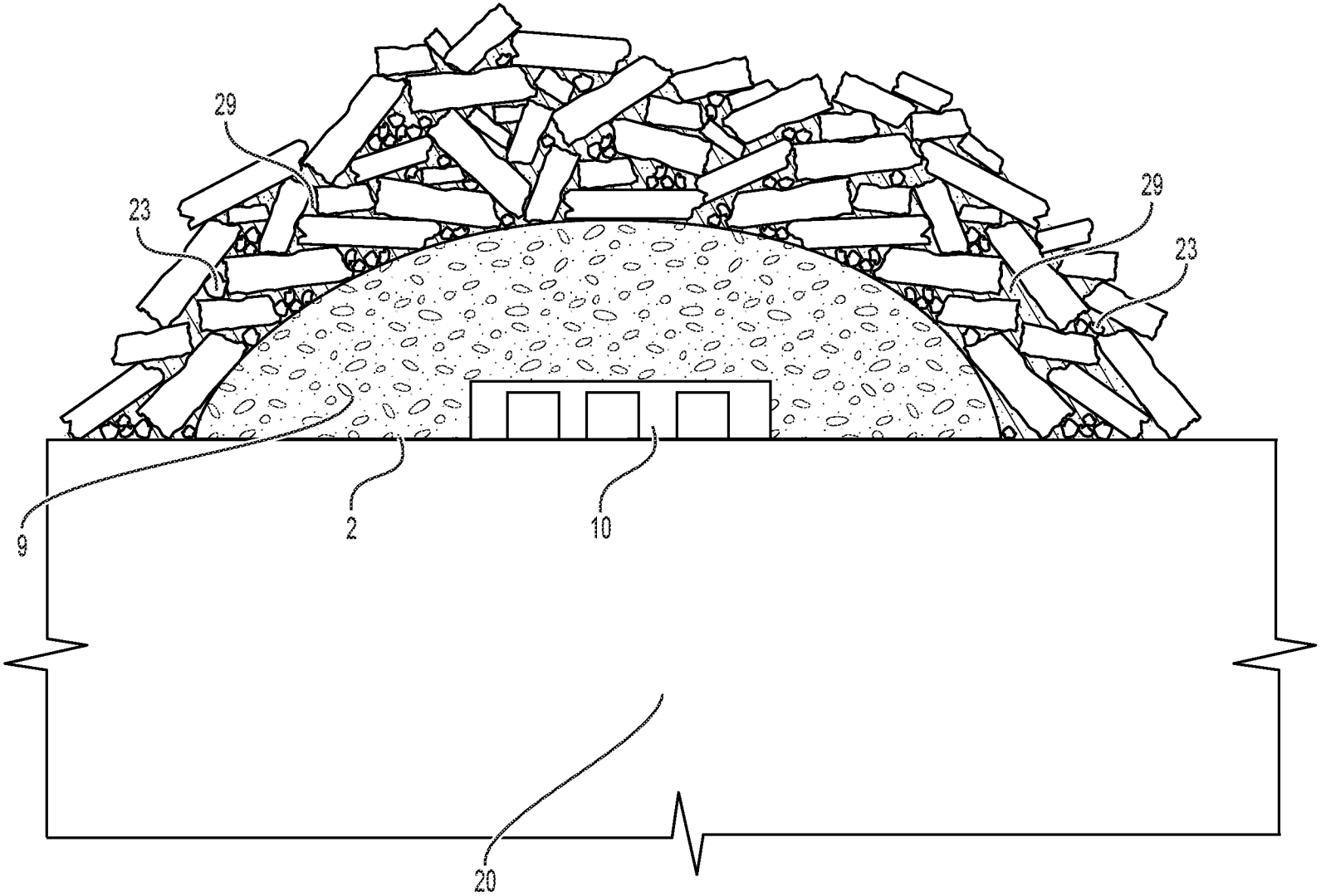

FIG. 5 Provides a section view of the drainage material and the concrete cover along with the grouted random fill.

Figure 6:
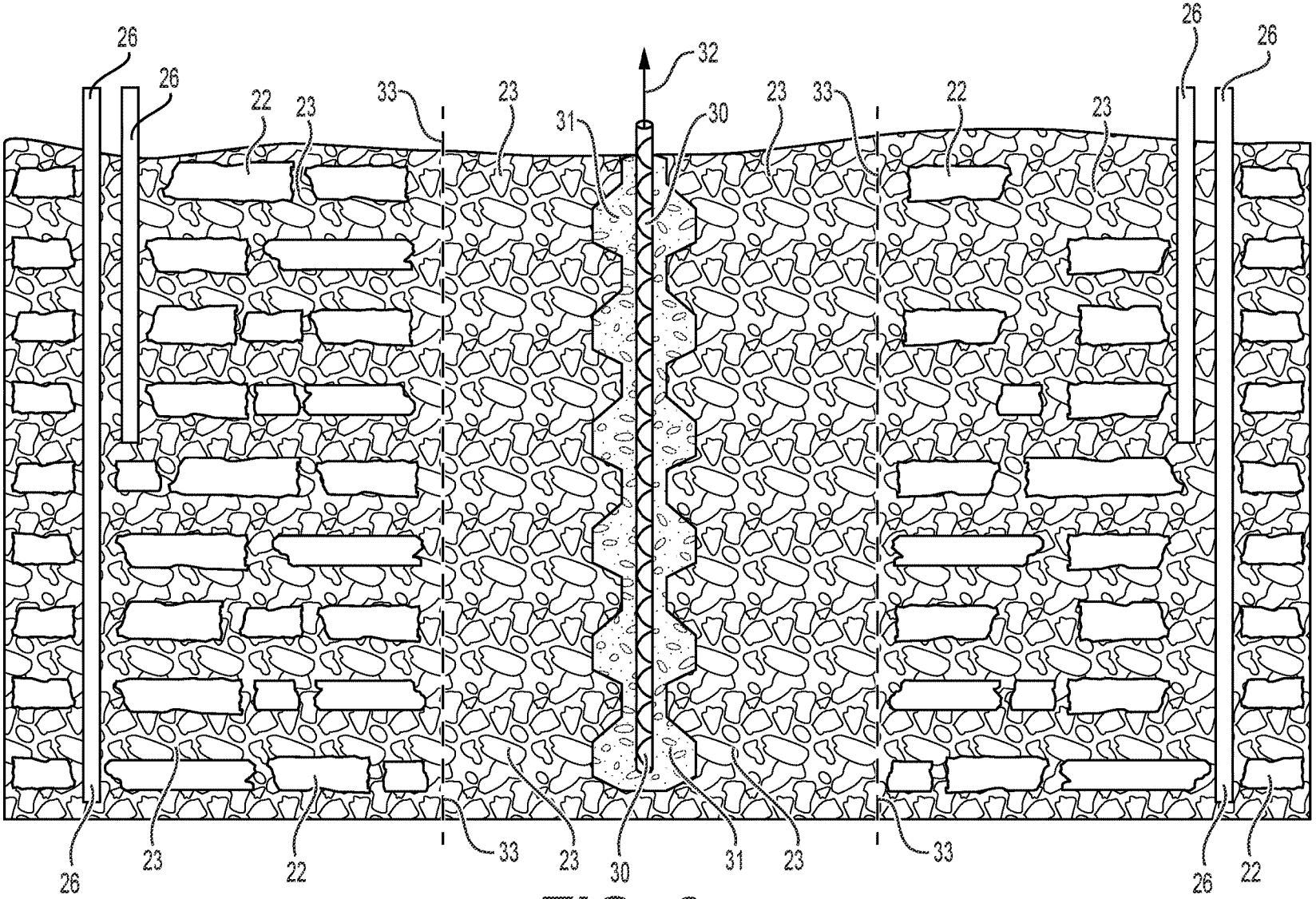

FIG. 6 Provides a possible method to test the minimum strength of the grouted random fill using a sacrificial test modified rebar.

Figure 7:
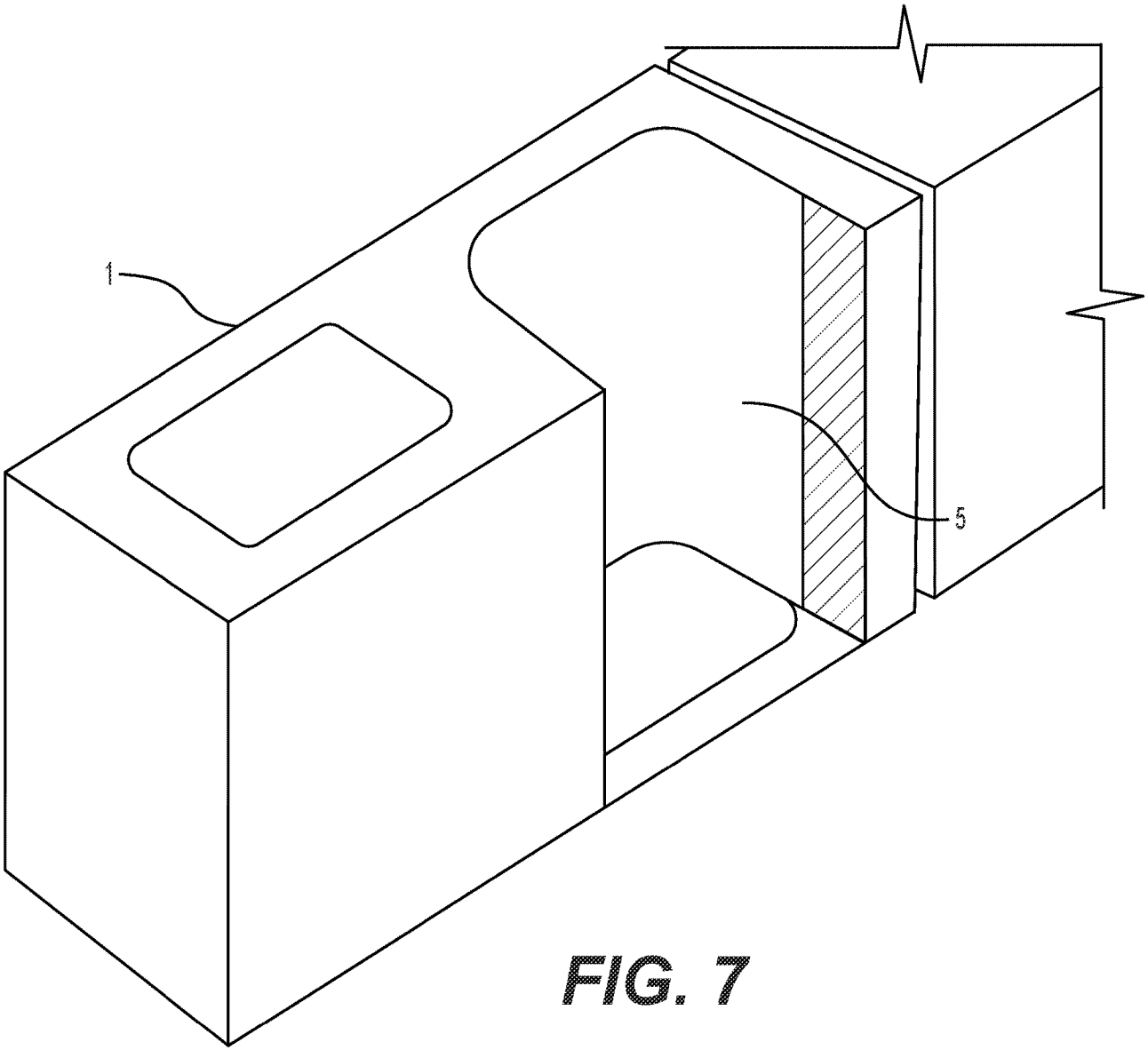

FIG. 7 Shows a typical concrete block with a minor modification to allow for the installation of a modified rebar into the wall face.

Figure 8:
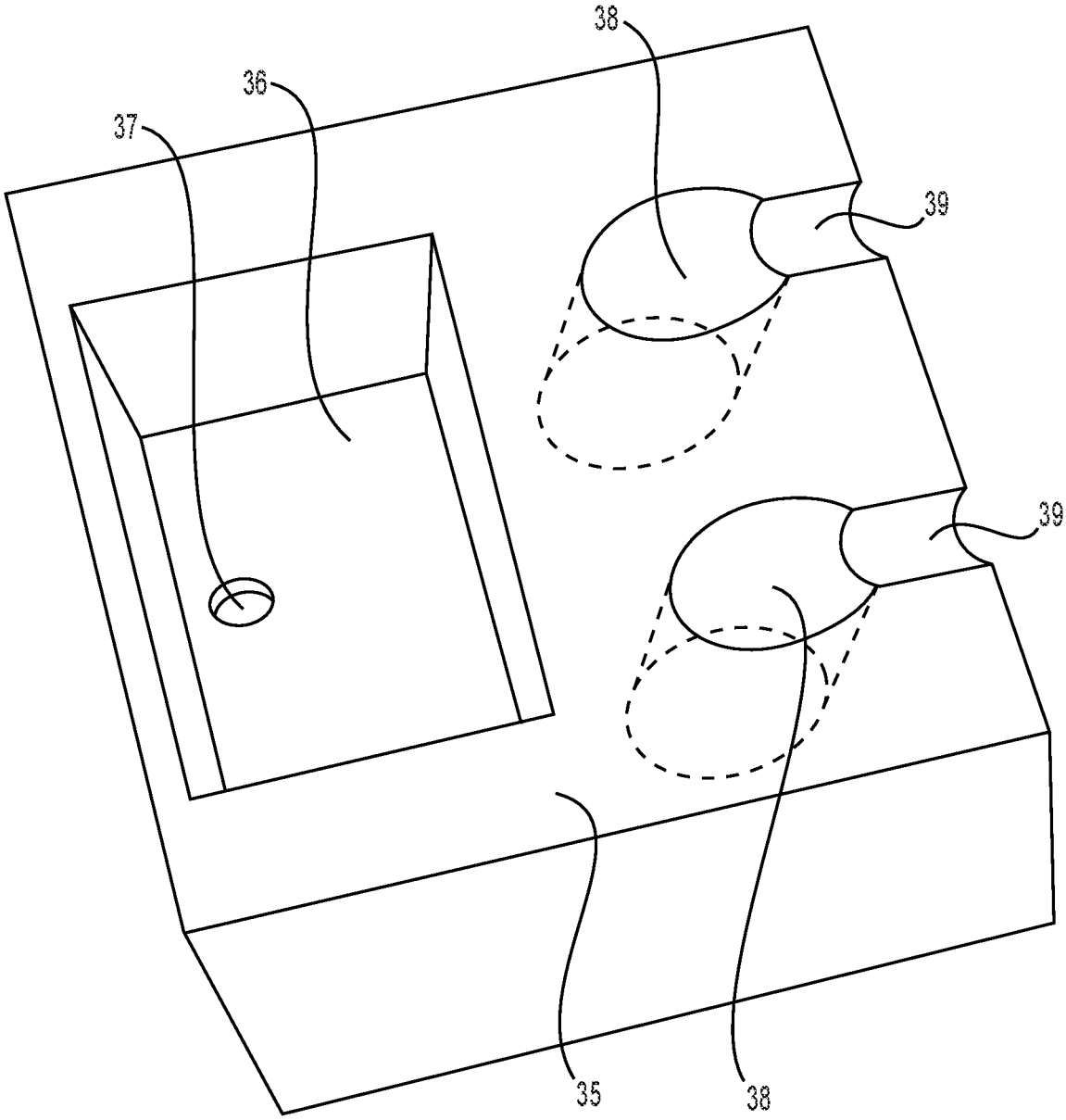

FIG. 8 Presents a perspective view of a planter block that is designed to work with the modified rebar used for the grouted random fill gravity wall.

Figure 9:
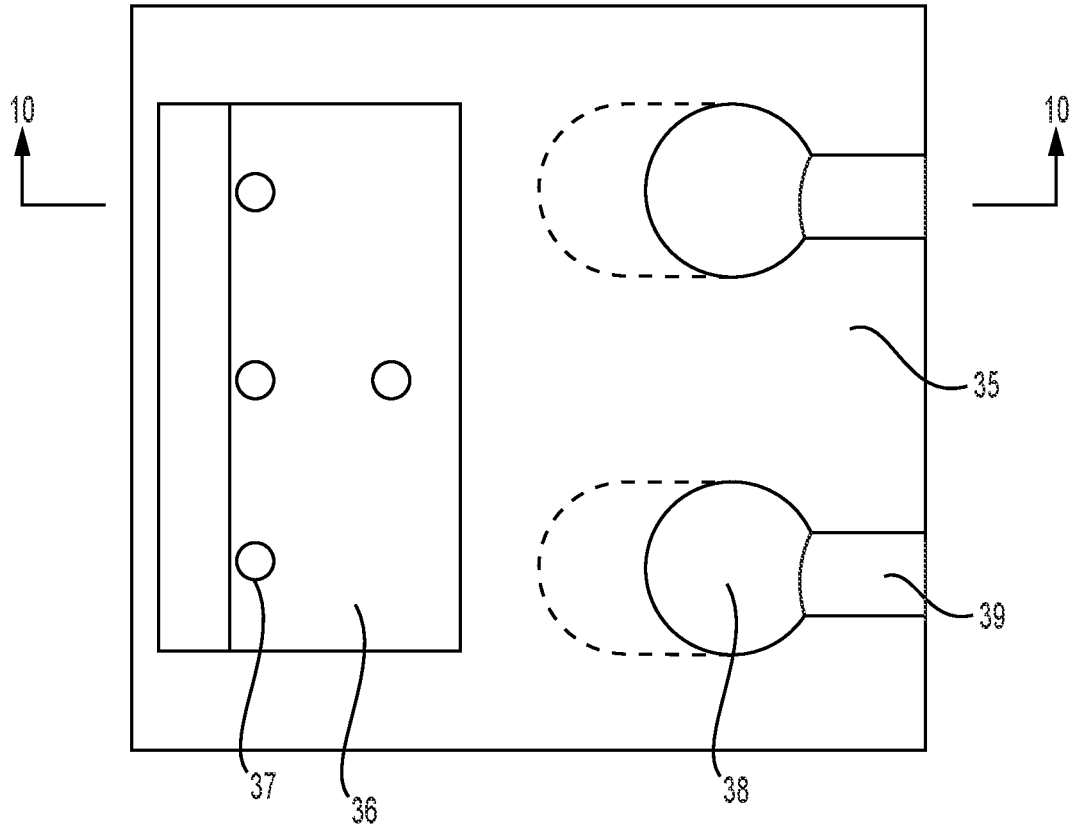
Figure 10:
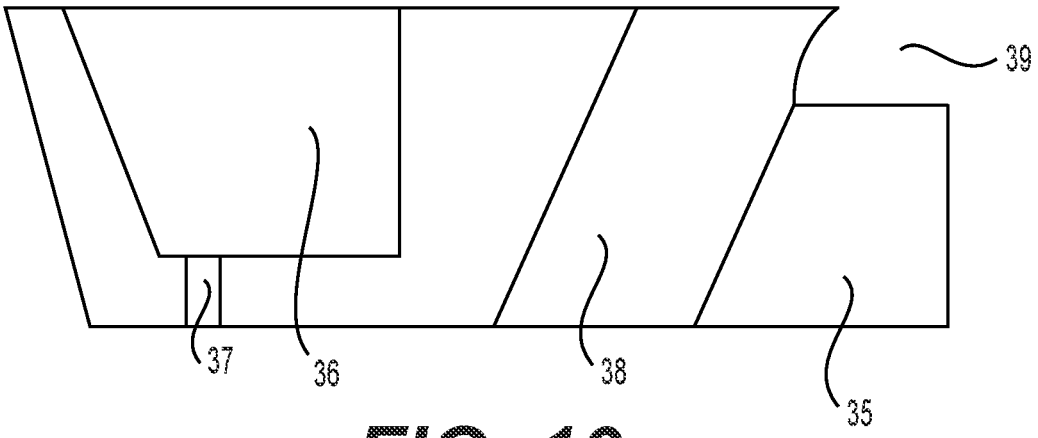

FIG. 9 Shows the same planter block from a vertical view and it shows the location of the vertical cut of FIG. 10.

FIG. 10 Shows a sectional view of the same planter block.

Figure 11:
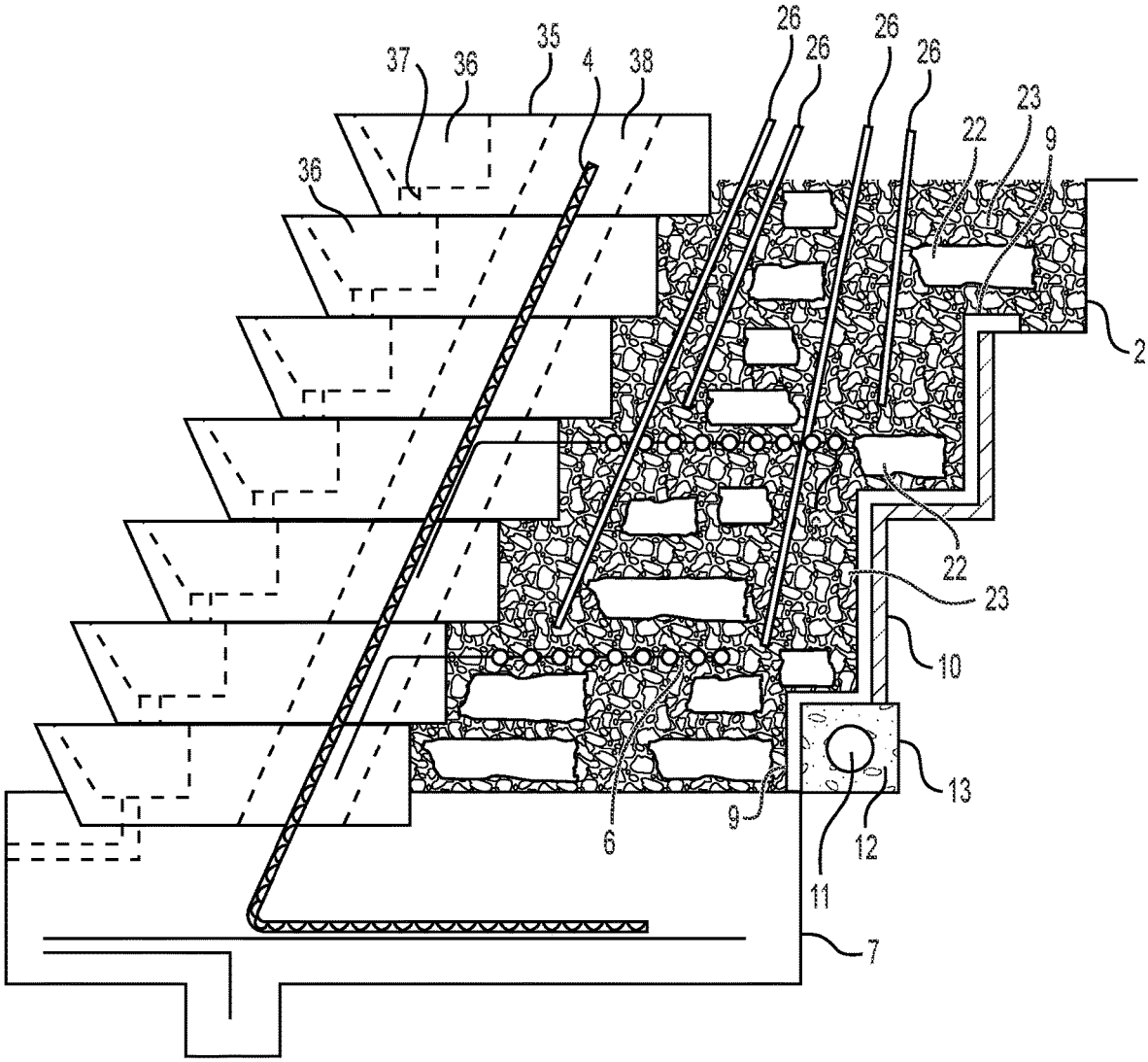

FIG. 11 Presents a cross sectional view of a random fill grouted gravity wall that uses the planter blocks for a wall face.

Figure 12:
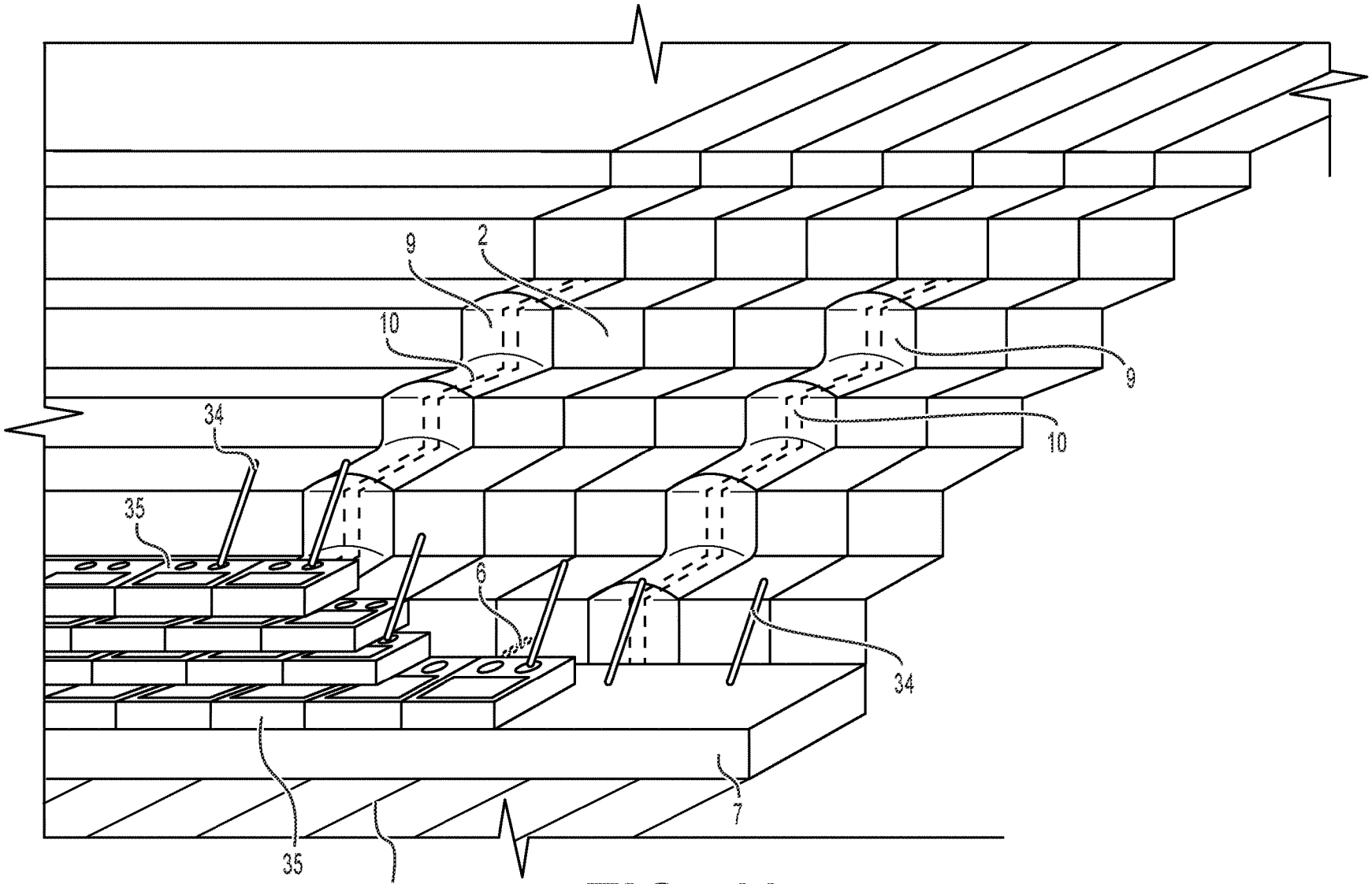

FIG. 12 Is a perspective view of a planter block gravity wall in construction.

Figure 13:
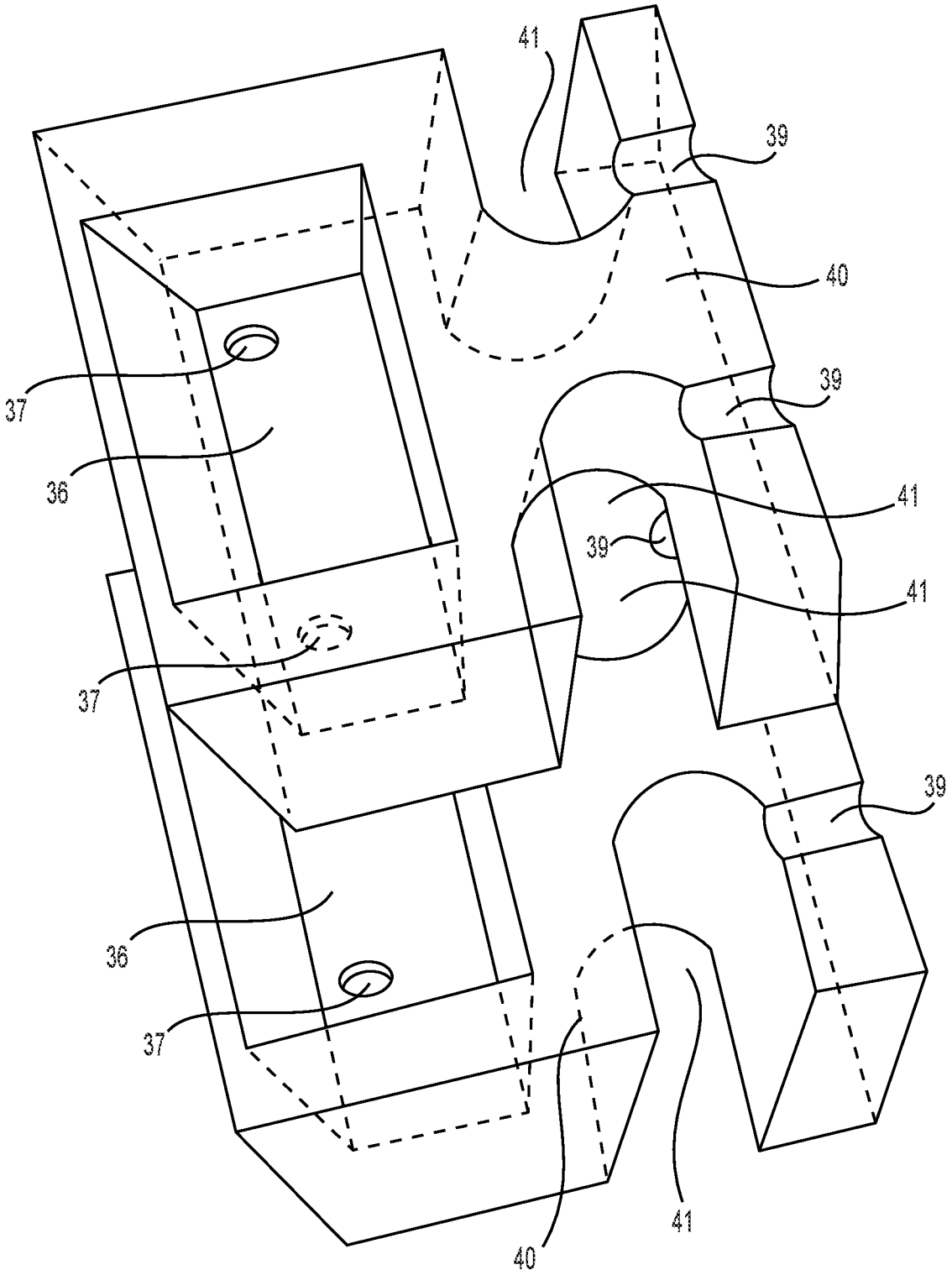

FIG. 13 Presents an alternative block design that could be used for a planter box wall face with a hole for the attachment of the modified rebar.

Figure 14:
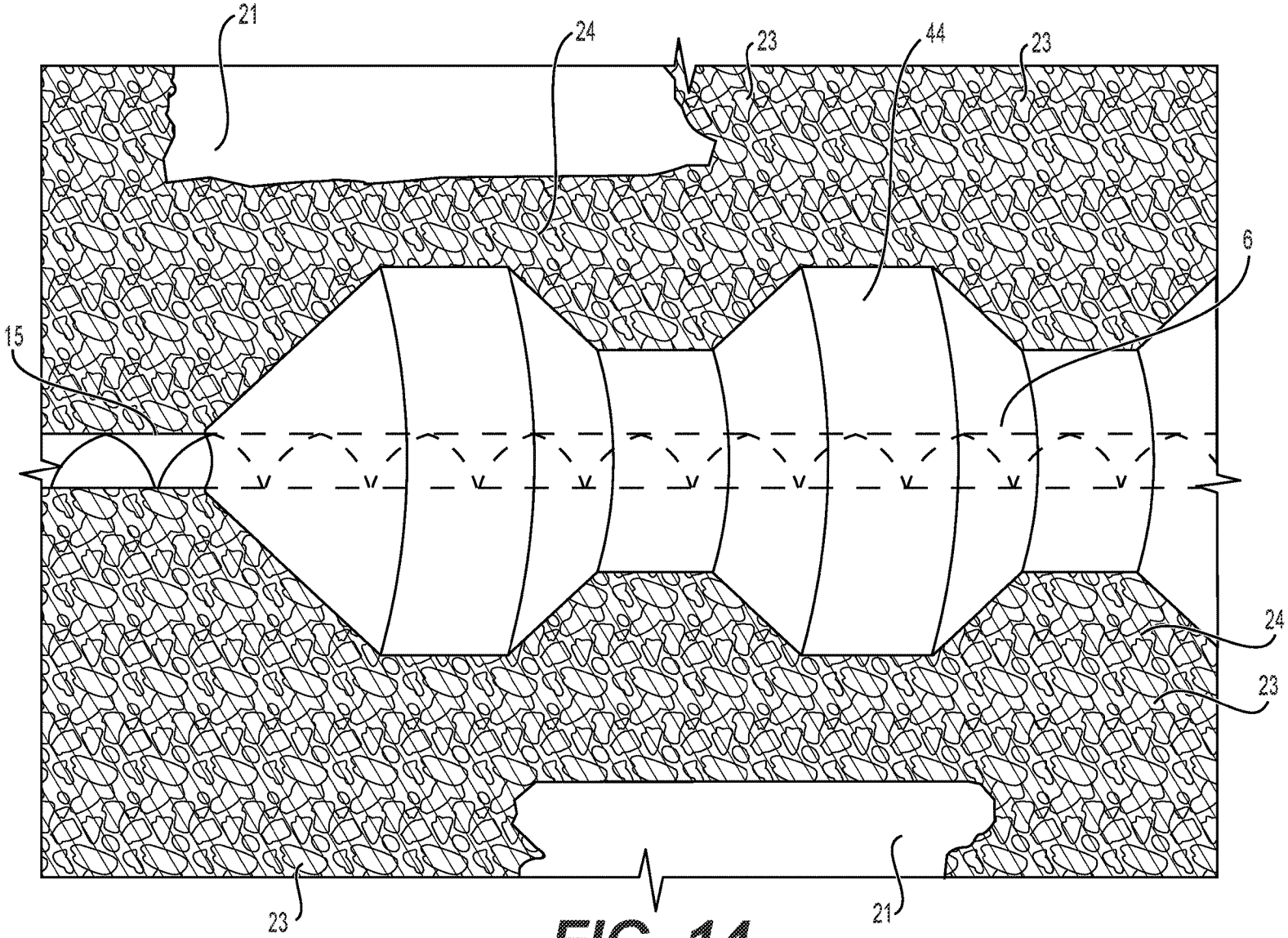

FIG. 14 Provides a detail showing how the rebar is modified with undulating concrete cast on to the rebar such that weaker grouted gravel can transfer load to and from the rebar to ensure that the wall face and the random fill will function as a unit.

FIGURES

The following discussion describes the enclosed Figures which are provided to show how the Green Gravity Wall would be constructed. It is important to follow the steps of the construction to ensure that all parts of the wall function as designed. First is a list of the numbered items that can be referred to when examining the figures.

NUMBERED ITEMS FOUND ON THE FIGS

1. Concrete Block Wall Face
2. Temporary Back Cut
3. Fully Grouted Cell
4. Rebar Inside Fully Grouted Cell
5. Open Cell Where the Back Side of the Block Was Cut Open
6. Modified Rebar Inserted into the Hole #5 or Hole #38
7. Concrete Foundation Structurally Designed
8. Gap Between the Back of Footing #7 and Back Cut #2 for the Subdrain
9. Concrete Cover to Protect Back Drain Material
10. Back Drain Material
11. Subdrain Perforated Pipe
12. Gravel Fill Around the Subdrain
13. Subdrain Filter Cloth
14. Wall Grout for the Modified Rebar
15. Non-modified Section of Rebar
16. Ground Surface in Front of Wall
17. Fill Zone Behind the Block Wall to be Lightly Grouted
18. Structural Fill Zone Tightly Grouted
19. Fill Zone Adjacent to Back Cut #2 may need to be Lightly Grouted
20. Ground to be Supported by the Retaining Wall
21. Original Slope Prior to Back Cut being Made
22. Demolition Concrete or Cobbles and Boulder Size Rocks
23. Gravel Fill Between Demolition Concrete and Rocks
24. Initially Lightly Grouted Zone Along the Back Side of the Block Wall
25. Excess Grout Foam to be Trimmed Off
26. Grout Injection Pipes Installed Along with the Gravel, Concrete, and Cobble and Boulder size Rocks
27. Grouted Gravel Fill Around Modified Rebar #6 or Test Rebar #30
28. Secondary Level of Lightly Grouted Zone along the Back Side of the Wall
29. Primary Grouted Zone for Strength
30. Test Rebar
31. Concrete Nodes Around Rebar for Testing the Grouted Fill
32. Test Load
33. Test Section Limits
34. Rebar Connecting Foundation to the Planter Blocks
35. Planter Blocks
36. Planter Box to be Filled with Soil and Plants
37. Drain Hole
38. Rebar Hole for Both Block #35 to Block #35 Connection and Modified Rebar to Tie Blocks #35 to the Grouted Fill
39. Horizontal Hole for Modified Rebar
40. Planter Block with alternate design of hole for the rebar
41. Elongated hole for the rebar
42. Horizontal Modified Rebar to tie the #17 Grouted Fill together along the length of the wall #1
43. Boundary between the grouted layers
44. Concrete cover cast upon the #15 rebar

FIG. 1

This figure shows a gravity wall in the process of being constructed. This is a perspective view from above, and behind the gravity wall. The block wall 1 has been constructed on top of a concrete foundation 7 with steel rebar 4 with cement grout 3 in some of the wall cells. Horizontal Modified Rebar 42 to tie the #17 Grouted Fill together along the length of the wall #1 The original slope has been trimmed removing loose topsoil to expose the back cut 2. Between the back of the foundation 7 and the base of the back cut 2 is a gap 8 for the proposed subdrain pipe 11 (not Shown). On the back cut is the back drain material 10 such as J Drain covered with concrete 9 to protect the back drain material from intrusion by the grout. This perspective shows the locations of three section cuts which will show the method of construction and how to test the strength of the structural fill. Section 2 shows the cross section through the back drain and the block wall and the fill sections. Section 3 shows the cross section through the area where the modified rebar 6 will attach the wall face to the structural fill. Section 6 will show how during construction a test section can be built into the fill and tested to determine its minimum strength.

FIG. 2 A

Figure 2A:
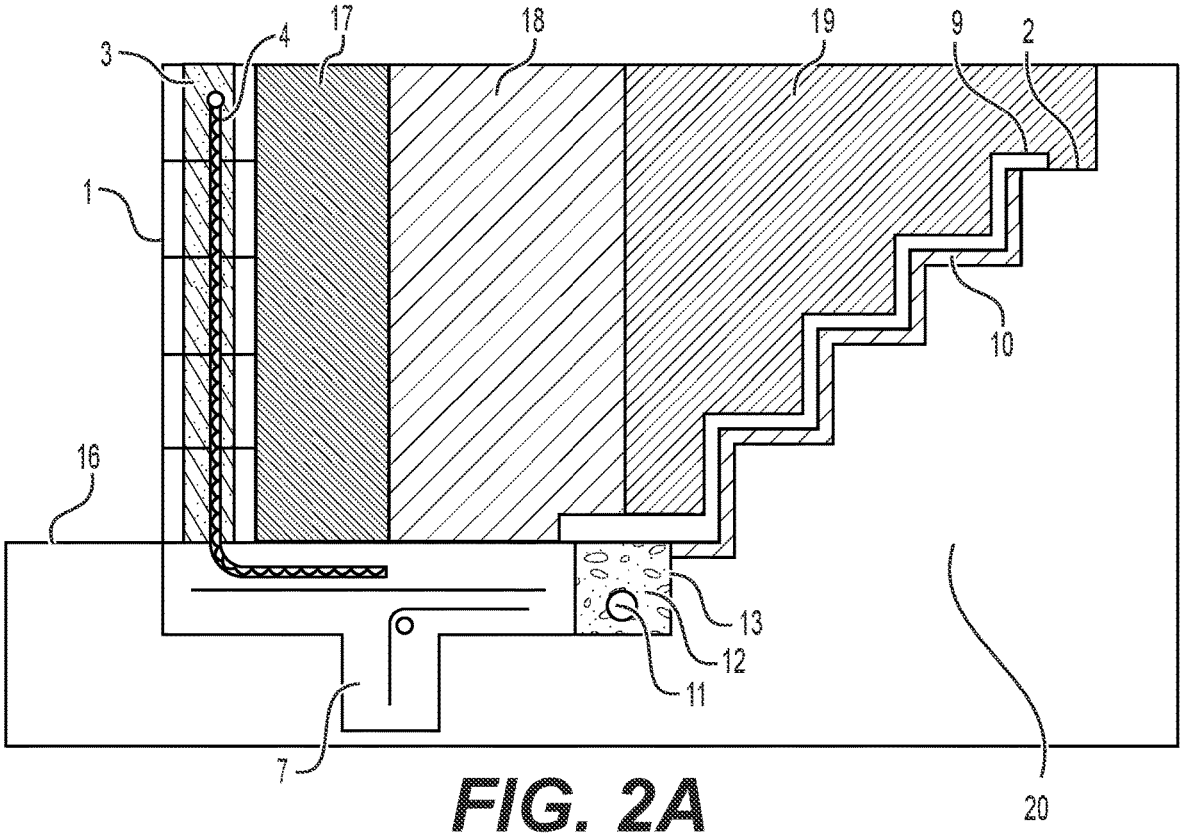
FIG. 2A Shows the three fill sections relative to the wall and the back cut along with the back-drain details.

FIG. 2A shows the basic layout of the wall fill sections. The area adjacent to the block wall fill Zone 17 will be lightly grouted to prevent large expansive forces from damaging the block wall. This Zone 17 will not be part of the structural fill zone. Zone 19 is also lightly grouted to protect the back drain material 10 by ensuring that the grout does not penetrate the soil to be supported to the extent that it flows into and around the concrete cover 9. It should be noted that in the event that the retaining wall is designed to support full hydrostatic pressure then this would not be necessary. Once the block wall 1 and the back drain material 10 are protected by the grout Zones 17 and 19, then the structural zone can be grouted to form Zone 18. This Zone 18 is to be grouted to its full extent to build the primary structural gravity wall. It should be noted that these same zones will be given different identification numbers in later figures as they become grouted zones.

This figure is intended to show the final goal of the gravity wall. Also, presented is a complete back drain system showing how the drainage material 10 ties into the subdrain pipe 11. The subdrain pipe 11 is typically a 4-to-6-inch diameter PVC pipe with slots or small holes. To ensure that the pipe does not become clogged the typical design is in the form of what is commonly call a burrito drain. Where the pipe 11 is surrounded by poorly graded gravel 12 and wrapped in filter cloth 13. In this case the filter cloth needs to be protected from the grout in zones 18 and 19 by the bottom section of the concrete cover 9 as shown in FIG. 2A.

FIG. 2B

Figure 2B:
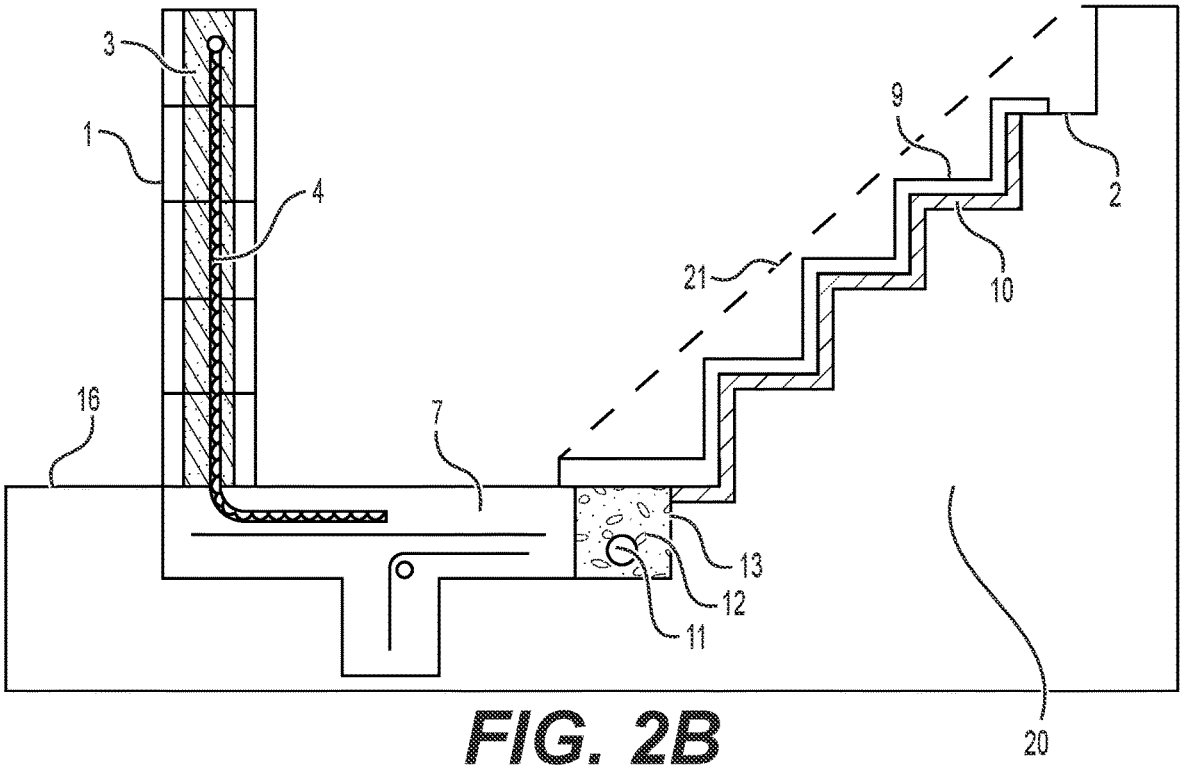
FIG. 2B Shows the preparation of the back-drain and back cut relative to the original slope.

FIG. 2B section shows the condition prior to the placement of fill and grout. This shows how the original slope 20 has been trimmed back to the temporary cut slope 2. Then the drainage material 10 and protective concrete cover 9 were placed on the cut slope 2. The drainpipe 11, gravel 12 and filter cloth 13 has been wrapped around the pipe 11 to protect the system.

FIG. 2C

Figure 2C:
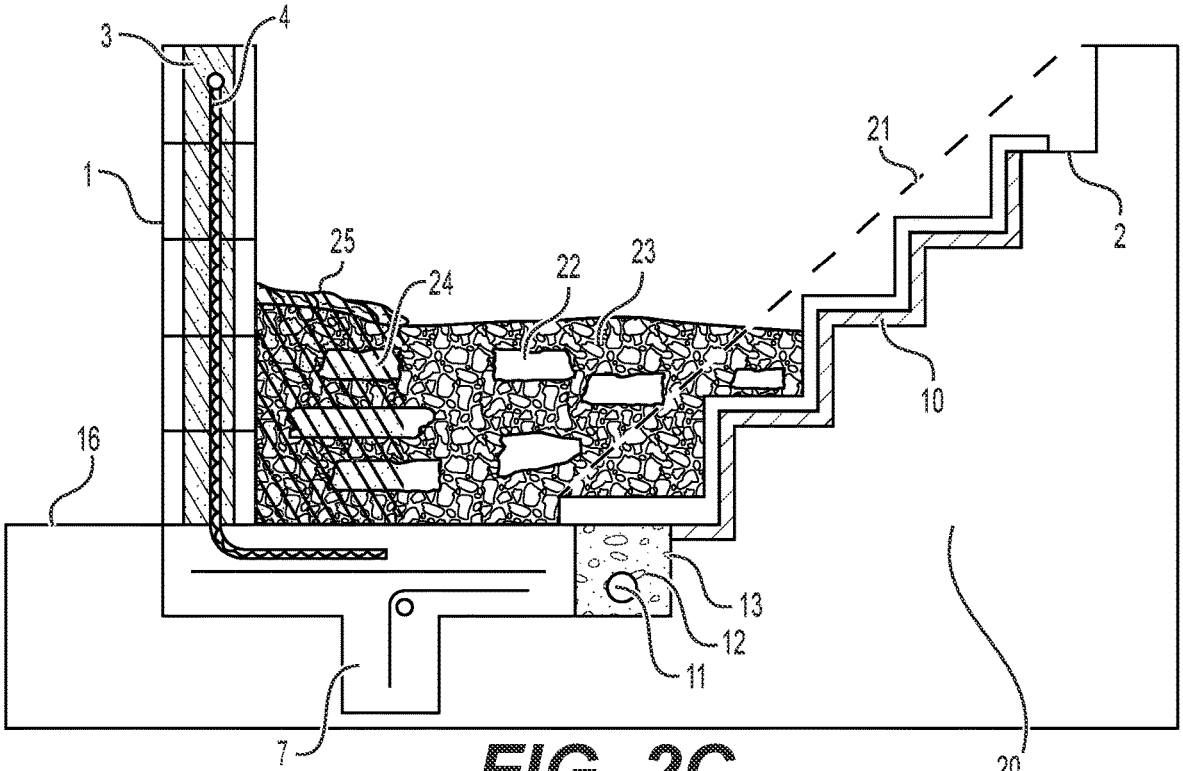
FIG. 2C Shows the beginning of the random fill being placed and initially grouted into place.

FIG. 2C section shows the condition where some fill has been placed and the lightly grouted zone 17 has started. Grout pipes 26 have been installed beyond this section. What is shown are the demolition concrete and rocks 22 in a matrix of gravel 23. If expansive grout is used then some of the grout will reach the temporary surface and expand to form a non-structural foam 25 that will need to be removed prior to placing an additional layer of fill.

FIG. 2D

Figure 2D:
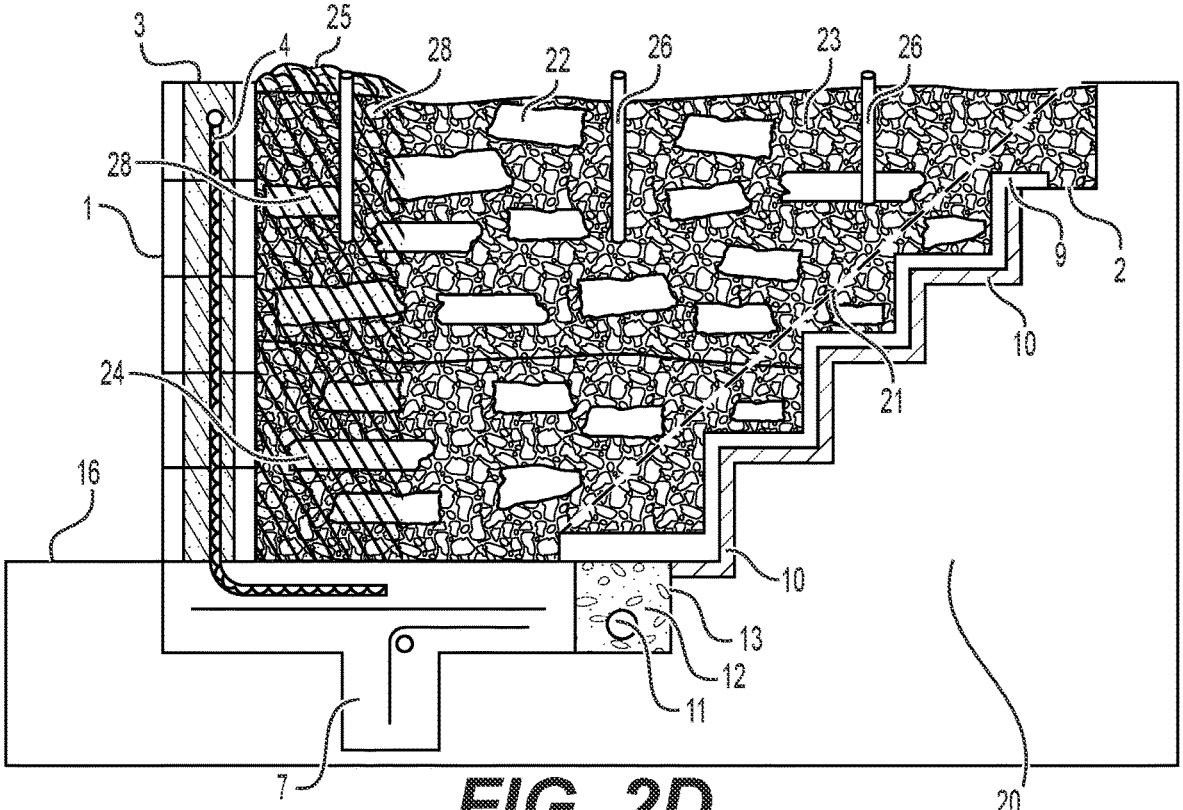
FIG. 2D Shows the random fill placed to its full height and the final stages of the three fill process.

FIG. 2D section shows all the fill has been placed to the top of the wall. A subsequent light grouting 28 has been injected into the next layer of fill adjacent to the wall. Also, as more fill is placed additional grout pipes 26 were installed. The second grouting also has created a foam layer 25 on top of the grouted zone. It should be noted that the drawings in this presentation show only two layers of grouting. If the proposed height of the retaining wall exceeds what can be completed in two lifts, then this same procedure could be followed for as many lifts as is necessary. The primary objective is to create a thick Zone 17 of grouted material that will spread the short-term load created when the structural Zone 19 is tightly grouted.

FIG. 2E

Figure 2E:
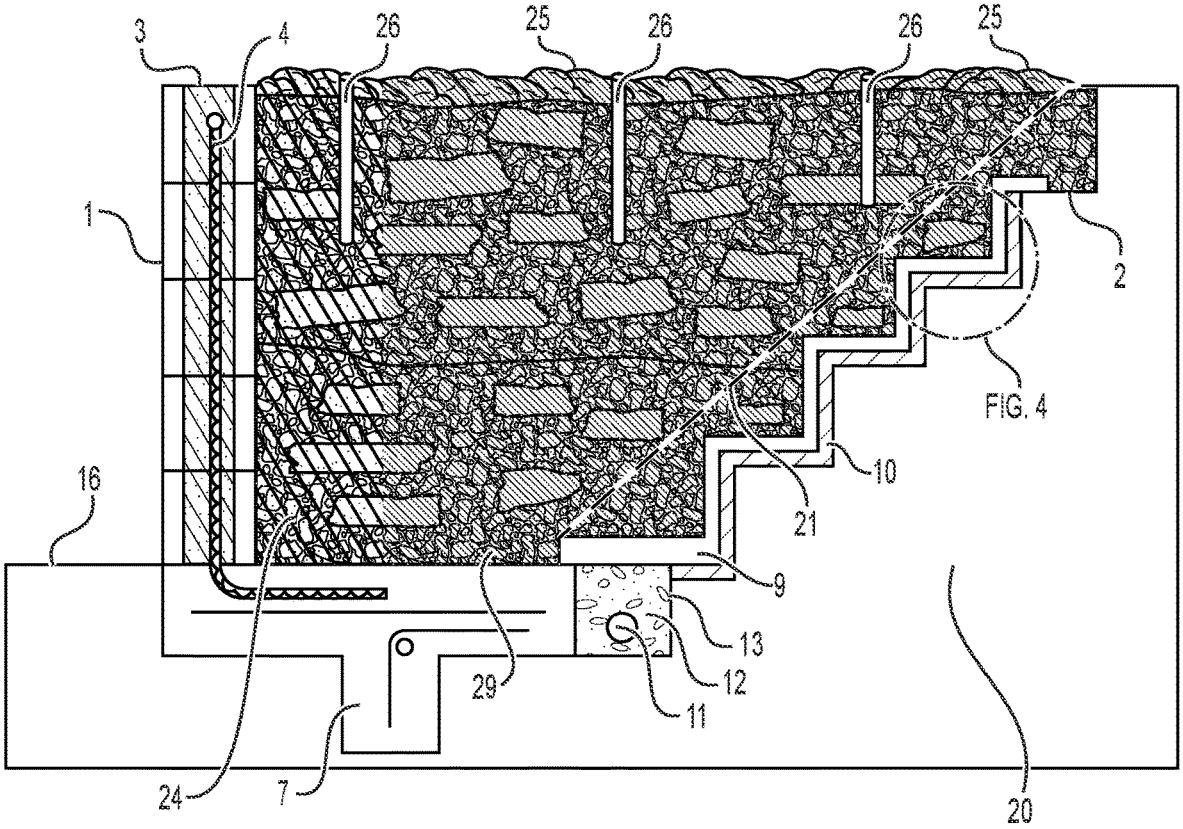
FIG. 2E Shows the final grouted gravity wall with both layers of grouting and the three fill sections. Also shown is the detail for the drainage presented on FIG. 4.

FIG. 2E shows the final stage of the grouting. The primary grouted zone 29 is shown by hatch marking where the line spacing is narrower than the initial lightly grouted zone 24 with heavy lines along the back side of the wall face. Depending on the ground conditions and the measures taken to protect the back drain material 10 a second lightly grouted zone 19 as shown on FIG. 2A may be needed along the back cut 2. The primary goal of FIG. 2E is to show that the size of the primary grouted zone 29 is critical to ensure the stability of the supported material 20. This is how all gravity walls are designed. Prior to construction the load from the supported material 20 is balanced against the resisting strength and mass of the planned primary grouted zone 29, to achieve the desired factor of safety. Again, the grouting will result in a temporary excess grout foam 25 which will need to be removed. After the grouting is complete the back drain material 10 should be tested to ensure that the grout in zone 29 does not interfere with its gravity drain capacity to elevate hydrostatic pressure.

FIG. 2E shows the location of the FIG. 4 enlargement of the back drain system.

FIG. 3A

Figure 3A:
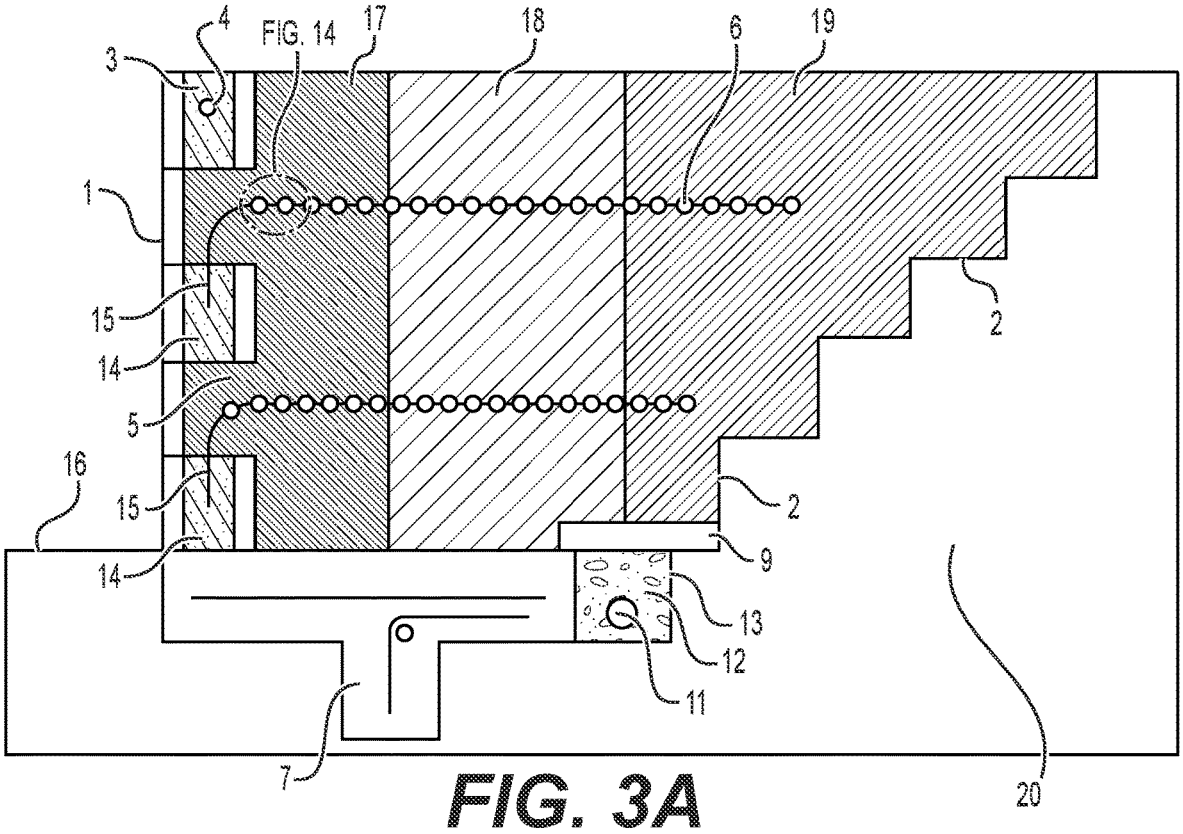
FIG. 3A Shows the same three fill sections as shown in FIG. 2A but this section shows how the grouted fill will interact with the horizontal modified rebar attaching the wall face to the grouted random fill. In addition the typical detail of the modified rebar shown in FIG. 14.

FIG. 3A shows the basic layout of the wall face and the fill sections. The area adjacent to the block wall fill Zone 17 will be lightly grouted to prevent large expansive forces from damaging the block wall. This Zone 17 will not be part of the structural fill zone. Zone 17 is intended to tie the block wall 1 to the lightly grouted fill Zone 17 through the use of the modified rebar 6, as shown in Section 3 A. Zone 19 is also lightly grouted to protect the back drain system shown in the figures related to Section 2. It should be noted that in the event that the retaining wall is designed to support full hydrostatic pressure then this would not be necessary. Once the block wall 1 and the back drain material 10 are protected by the grout Zones 17 and 19, then the structural zone can be grouted to form Zone 18. This Zone 18 is to be grouted to its full extent in order to build the primary structural gravity wall. It should be noted that these same zones will be given different identification numbers in later figures as they become grouted zones.

This figure is intended to show the final goal of the gravity wall. Also presented is the subdrain pipe 11 which is typically a 4-to-6-inch diameter PVC pipe with slots or small holes. To ensure that the pipe does not become clogged the typical system is to form what is commonly call a burrito drain. Where the pipe 11 is surrounded by poorly graded gravel 12 and wrapped in filter cloth 13. In this case the filter cloth needs to be protected from the grout in zones 18 and 19 by the bottom section of the concrete cover 9 as shown in FIG. 3A.

FIG. 3B

Figure 3B:
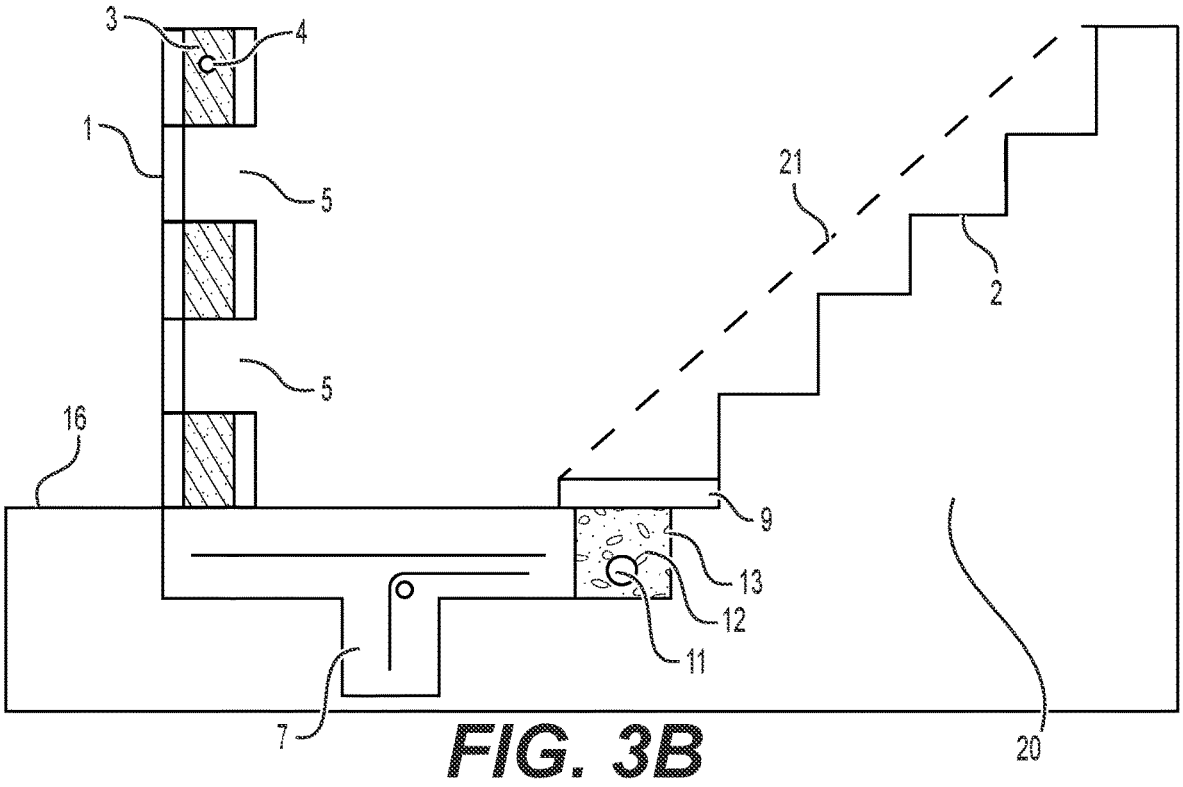
FIG. 3B Shows the open wall sections where the modified rebar will be inserted into the wall face.

FIG. 3B shows the condition prior to the placement of fill and grout. This shows how the original slope 20 has been trimmed back to the temporary cut slope 2. Then the drainage material is not continuous and therefore only the drain is presented. The drainpipe 11, gravel 12 and filter cloth 13 has been wrapped around the pipe 11 and gravel 12 to protect the system. FIG. 3B shows the open segments of the blocks 5 prior to the installation of the modified rebar 6 (not shown).

FIG. 3C

Figure 3C:
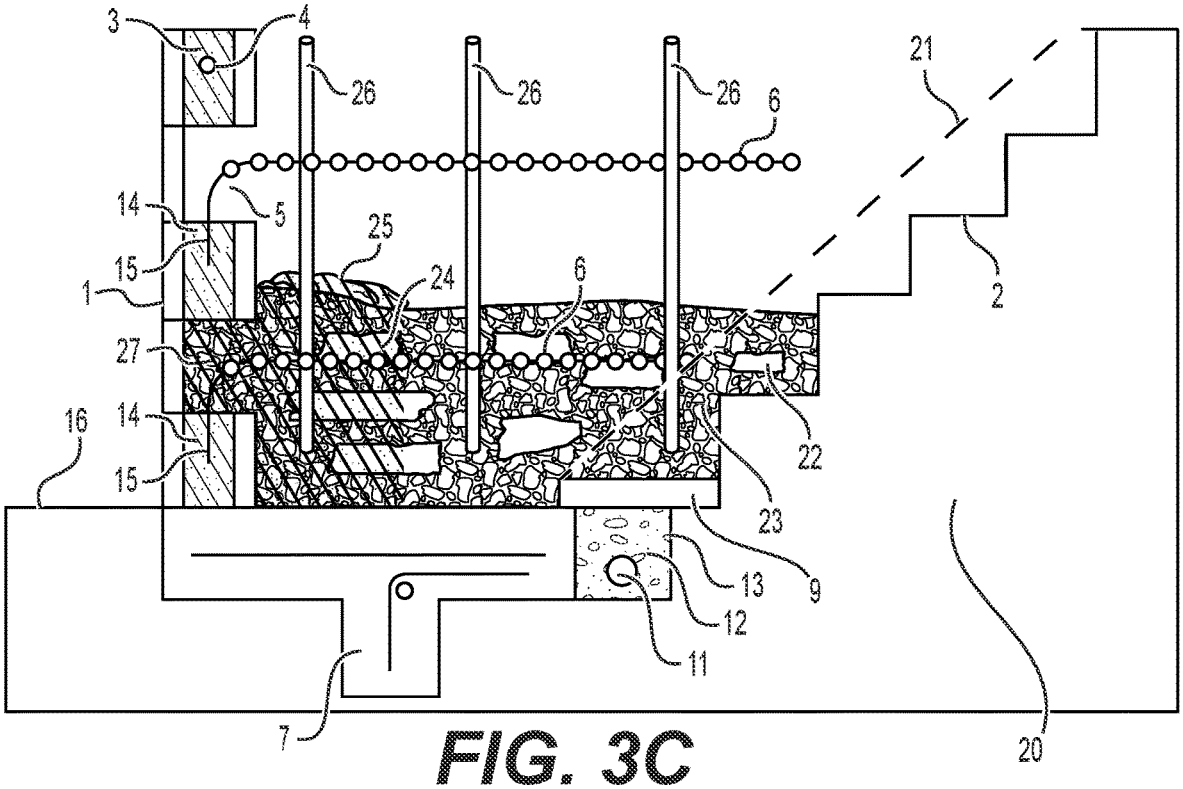
FIG. 3C Shows the first layer of random fill being grouted to the wall face modified rebar.

FIG. 3C shows the condition where some fill has been placed and the grouting of the lightly grouted zone 17 has started. Grout pipes 26 have been installed along with the broken segments of demolition concrete and rocks 22 in a matrix of gravel 23. Both modified rebar 6 have been placed in the concrete grout 14 to tie the nonmodified section of rebar 15 to the wall. The opening in the block 5 below the fill level has been filled with gravel 23 and grouted in place by the initial grout 24. If expansive grout is used, then some of the grout will reach the temporary surface and expand to form a non-structural foam 25 that will need to be removed prior to placing an additional layer of fill.

FIG. 3D

Figure 3D:
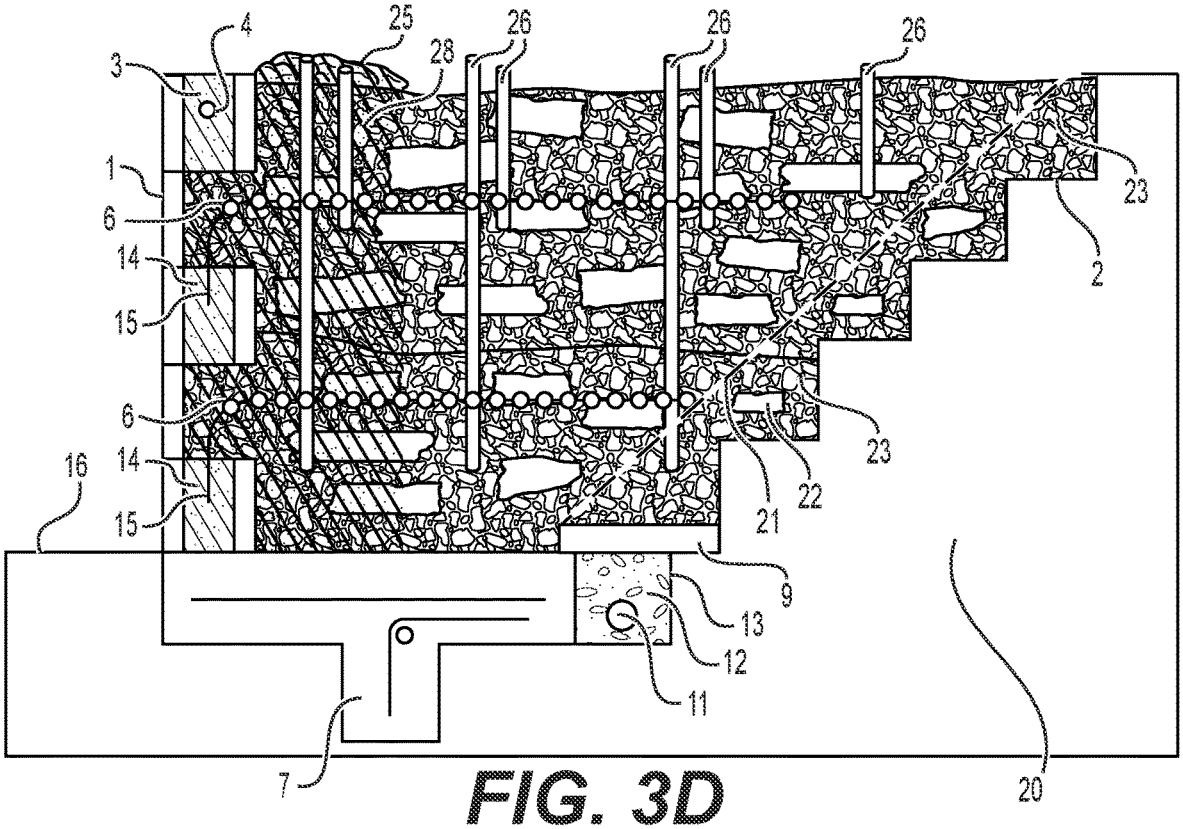
FIG. 3D Shows the full height of the random fill with the grout pipes in place for all three sections of the grouting process.

FIG. 3D shows the fill has been placed to the top of the wall. A subsequent light grouting 28 has been injected into the next layer of fill adjacent to the wall. Also, as more fill is placed additional grout pipes 26 were installed. The second grouting also has created a foam layer 25 on top of the grouted zone. It should be noted that the drawings in this presentation show only two layers of grouting. If the proposed height of the retaining wall exceeds what can be completed in two lifts, then this same procedure could be followed for as many lifts as is necessary. The primary objective is to create a thick Zone 17 of grouted material that will spread the short-term load created when the structural Zone 19 is tightly grouted.

FIG. 3E

Figure 3E:
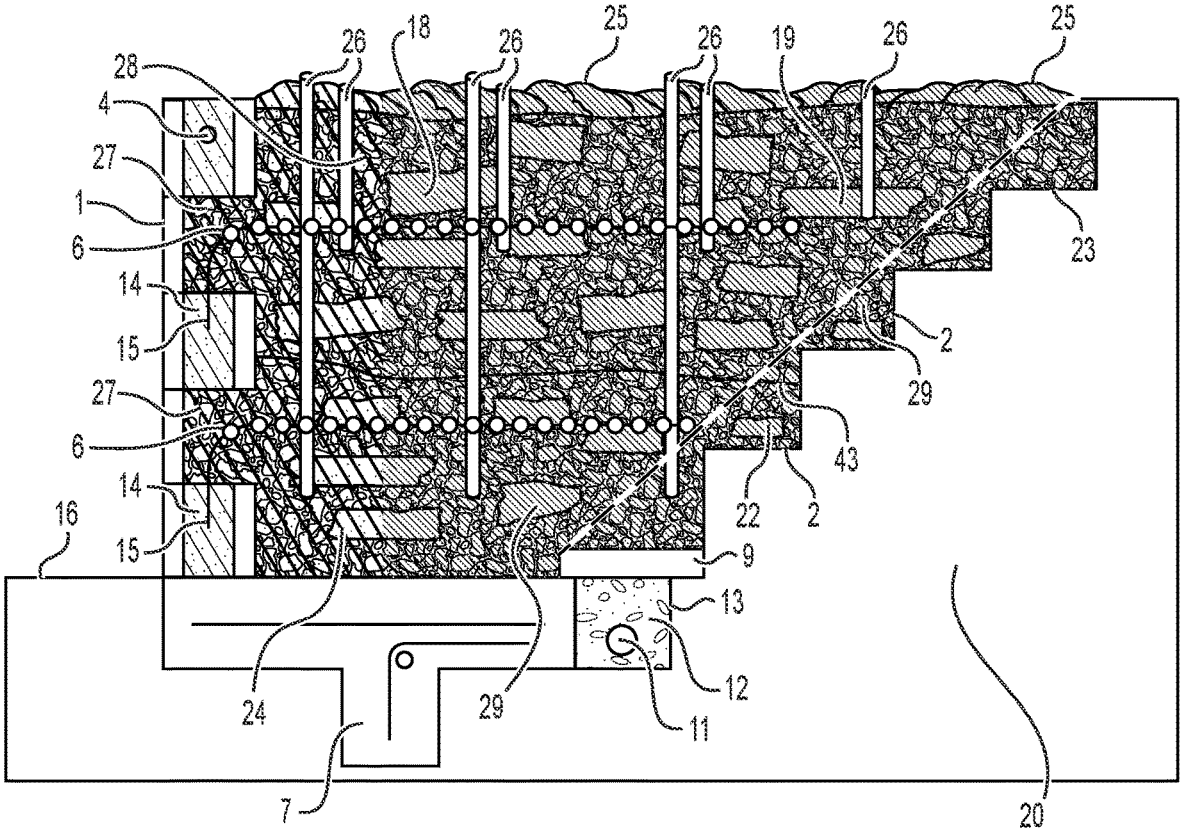
FIG. 3E Shows the final grouting of the gravity wall and the modified rebar to ensure that the wall face and the three sections function a one unit.

FIG. 3E show the final stage of the grouting. The primary grouted zone 29 is shown by hatch marking where the line spacing is finer than the initial lightly grouted zone 24 along the back side of the wall face. Depending on the ground conditions and the measures taken to protect the back drain system a second lightly grouted zone 19 as shown on FIGS. 2A and 3A may be needed along the back cut 2. The primary goal of FIG. 3E is to show that the size of the primary grouted zone 29 is critical to ensure the stability of the supported material 20. This is how all gravity walls are designed. Prior to construction the load from the supported material 20 is balanced against the resisting strength and mass of the planned primary grouted zone 29 by a ratio that is the factor of safety. Again, the grouting will result in a temporary excess grout foam 25 which will need to be removed. After the grouting is complete the back drain system should be tested to ensure that the grout 29 does not interfere with its gravity drain capacity to elevate hydrostatic pressure. Also shown is the boundary between the layers 43.

FIG. 4

FIG. 4 shows the back cut 2 in perspective with the concrete cover 9 over the back drain material 10. Also shown is the location of a section view presented on FIG. 5. For the purposes of clarity, the fill materials 22 and 23 and the primary grout 29 are not shown in this view.

FIG. 5

FIG. 5 shows a cross sectional view of the back cut 2 and the back drain material 10 and the concrete cover 9. Also shown in this view is the gravel fill 23 and the primary grout 29. This section view also includes the ground to be supported 20 which is being drained.

FIG. 6

FIG. 6 shows a longitudinal section where the fill zone has been limited to gravel fill 23 only. This is to provide a test zone to determine the minimum strength of the primary grouted zone. This view is just prior to the grout being injected through the grout tubes 26. The bulk of the primary grouted zone is filled with demolition concrete and rock 22. The rock and concrete are placed in a random fashion and although they add strength to the structural gravity fill it cannot be counted upon unless there are minimum placement specifications. This figure is intended to provide a method to test the minimum strength of the design gravity fill. For the design presented herein the lowest strength material that is made up of the granular fill 23 at the maximum distance from the grout injection points 26. The figure shows two dashed lines 33 that are the limit of the test section. In the center of the test section is a rebar 30 that is covered with concrete nodes 31. After the gravel fill 23 has been grouted with grout around modified rebar 30 and its concrete cover 31, then it can be loaded with test pull out load 32. If the rebar is not pulled out with a predetermined minimum load then it is safe to assume that the remainder of the structural fill in Zone 18 forming the gravity wall has at least that amount of shear strength.

FIG. 7

FIG. 7 shows a modified concrete block that forms the open cell 5 in the back of concrete block wall face 1. The blocks could either be cut to form the opening or by using a modified mold.

FIG. 8

Figure 1:
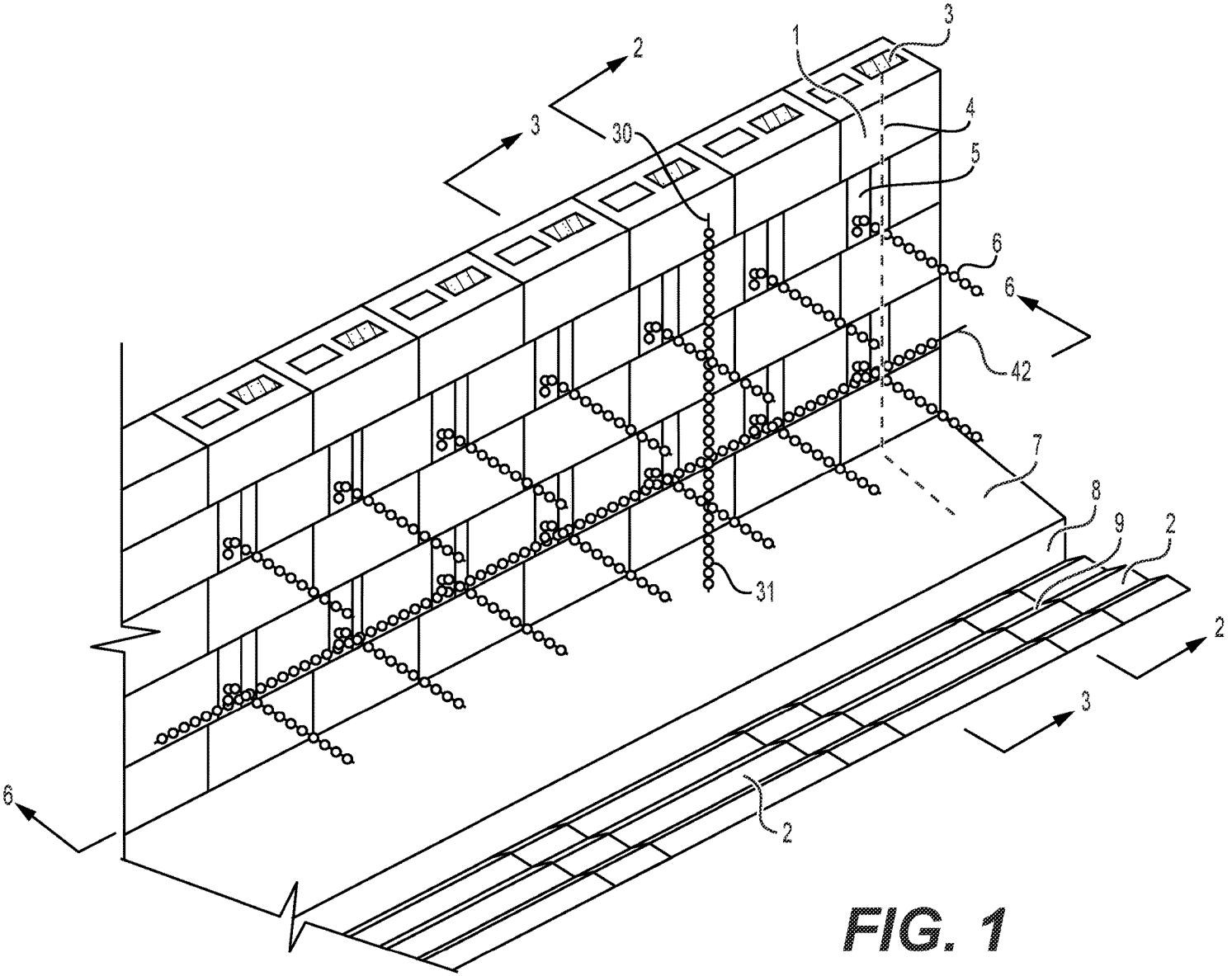

FIG. 8 presents a perspective view of an alternate block 35 that could be used as an alternative to the typical concrete block wall 1 described in FIG. 1. This block has the advantage of having a planter box hole 36 on the front side. Each planter box hole 36 has a one or more small drain holes 37 designed to drain from one block down to the next block below. Each block has grouting holes 38 that are sloped so that each row of blocks is set back from the one below so that part of the planter box 36 is exposed to allow plants to grow out of the wall. Each grout hole 38 has a smaller horizontal hole 39 that allows a modified rebar 6 to be inserted into hole 38. This is intended to tie the blocks 35 to the primary 28 and secondary 29 grouted fill, in fill Zones 17 and 18.

FIG. 9

FIG. 9 is a top view of the block 35. This view shows the planter box 36 with its drain holes 37 and the grout holes 38 and the horizontal holes 39. This view also shows a section view FIG. 10.

FIG. 10

FIG. 10 shows a cutaway section of block 35. This section is cut through the planter box 36 with a drain hole 37 and the grout hole 38 with its horizontal hole 39.

FIG. 11

FIG. 11 shows a cross section of a wall of planter blocks 35 in front of the gap between the wall and the temporary back cut 2. The blocks are held in place by the rebar 4 in the connected holes 38. The bottom block is tied to the concrete foundation 7 by the rebar 4. In addition to the rebar 4 the blocks 35 are also tied to the grouted fill by modified rebar 6 that pass-through hole 39. From that point the rebar 6 is bent to align with the larger connecting holes 38. For clarity the figure does include the gravel 23 and rock 22 fill that would be grouted. The grout pipes 26 are shown because during construction they would be placed into the fill as the fill is placed. Also, the back cut 2 is shown with a drainage system. This is the same as discussed above where back drain material 10 is placed on the back cut 2 and protected from the grout by concrete cover 9 that leads down to a perforated pipe 11 surrounded by gravel 12 and wrapped in filter cloth 13.

FIG. 12

FIG. 12 shows a perspective drawing showing the wall during construction from a point in front and slightly above the wall. On the left side there are four layers of planter blocks 35 set on top of the concrete foundation 7. The concrete foundation has rebar 34 sticking up at the same angle as the grout holes 38. The temporary back cut 2 has the back drain material 10 which is covered by the protective concrete cover 9. Also shown is one of the horizontal modified rebar 6. The fill material is not shown for clarity. As the wall is constructed it would be filled and grouted in a process similar to the method outlined for the concrete block wall above.

FIG. 13

FIG. 13 Presents an alternative block 40 designed that could be used for a planter box 36 wall face with a slot 41 for the attachment of the modified rebar. This view shows two blocks 40 stacked such that the two slots 41 form a complete hole. Horizontal hole 39 is also shown.

FIG. 14

FIG. 14 Provides a detail previously noted a modified rebar 6. This detail shows how the rebar 15 is modified with undulating concrete 44 cast on to the rebar such that weaker grout 24 and gravel 23 can transfer load to and from the rebar. These modified rebars are designed to ensure that the wall face 1 and the random fill will function as a unit.

The invention claimed is:

1. A method of forming concrete on steel rebars for a retaining wall, comprising:

Providing a plurality of steel rebars covered with concrete elements molded in a series of undulating shapes within a grouted fill to form a gravity mass retaining structure behind a concrete wall face; wherein concrete nodes of the concrete elements are molded around all or part of a respective rebar to make modified rebars; wherein the concrete cures until reaching a minimum compressive strength of 2000 psi prior to being used for the purpose of structurally tying the grouted fill; wherein each of the rebars used to attach the g routed mass to the concrete wall face contain a non-modified portion free of concrete nodes; wherein the undulating shapes of the concrete of each modified rebar has a minimum section of 1.5 inches over the steel rebar and a maximum section of at least 1.5 times the minimum section and the slope of the undulating shapes between the minimum and maximum sections are sloped at between 20 and 45 degrees measured from the longitudinal axis of the rebar; and Attaching non-modified portions of the respective rebars within the wall face of the retaining structure to create a gravity retaining wall within an area between a back cut in the ground to be supported by the retaining structure and the wall face using cohesive soil fill and large debris fill; wherein the large debris fill is concrete rubble from demolition projects or boulder and cobble size rocks; wherein the large debris fill is made of large debris fill elements which leaves large void spaces between the large debris fill elements; wherein the large void spaces are initially filled with gravel size rocks to make a mechanical connection between the concrete nodes of each rebar and the large debris fill elements; wherein the non-modified portions of the respective rebars are attached within the wall face and then bent towards the grouted fill behind and supported by the wall face; and Placing grout pipes simultaneously with the rebars and the grouted fill; wherein the grout pipes are placed at designed locations to communicate with the large void spaces; grouting material is then injected through each of the grout pipes into the large void spaces to lock the cohesive soil fill and large debris fill with the concrete nodes and rebars to form a solid reinforced mass that support horizontal and vertical loads from the material behind the gravity retaining wall.

2. The method of claim 1, further comprising wherein the grouted fill of the gravity retaining wall functions as a single unit due to the inclusion of said modified rebars to tie the entire mass together to provide uniform support to the supported ground behind said gravity retaining wall.

3. The method of claim 1, further comprising wherein the gravity retaining wall is tested by first testing the strength of each proposed fill to determine which fill material has the lowest strength and then creating selective grout zones around the modified rebars within the lowest strength fill material and performing pull out tests on said modified rebar that are g routed into the lowest strength material for that particular project.

4. The method of claim 1, further comprising verifying that the gravity retaining wall performs as designed.

5. The method of claim 1, further comprising providing for an environmentally friendly option of constructing the gravity retaining wall by using inert debris fill generated by demolition of existing structures and placing the inert debris within the grouted fill of the gravity retaining wall.

6. The method of claim 5, further comprising wherein the use of inert debris fill reduces the noise and vibration cause by compaction equipment due to the inert debris fill being placed loosely along with the gravel sized rocks and modified rebars and then grouted in place to form the solid reinforced mass of the gravity retaining wall.

7. The method of claim 1, further comprising using fine grained soils as the cohesive soil fill and placing horizontal or near horizontal layers of modified rebars laid out in a grid pattern along with a covering of gravel size rocks and grout pipes to provide the necessary reinforcing.

8. The method of claim 1, wherein the retaining structure is an improved mechanically stabilized earth (MSE) wall.

* * * * *